US006675753B2

(12) United States Patent
Nishikawa

(10) Patent No.: US 6,675,753 B2
(45) Date of Patent: Jan. 13, 2004

(54) CAM PHASE VARIABLE APPARATUS

(75) Inventor: Yutaka Nishikawa, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/206,184

(22) Filed: Jul. 29, 2002

(65) Prior Publication Data

US 2003/0029401 A1 Feb. 13, 2003

(30) Foreign Application Priority Data

Aug. 8, 2001 (JP) ..... 2001-240269
Dec. 25, 2001 (JP) ..... 2001-390981

(51) Int. Cl.[7] ..... F01L 1/34

(52) U.S. Cl. ..... 123/90.17; 123/90.15; 123/90.16

(58) Field of Search ..... 123/90.17, 90.11, 123/90.15, 90.16, 90.27, 90.31, 90.39, 90.4, 90.44, 445, 473; 91/369.4

(56) References Cited

U.S. PATENT DOCUMENTS 4,305,352 A * 12/1981 Oshima et al. ..... 123/90.15
4,726,331 A * 2/1988 Oyaizu ..... 123/90.15
5,178,106 A * 1/1993 Suga ..... 123/90.17

FOREIGN PATENT DOCUMENTS

JP 11-223113 A 8/1999

* cited by examiner

*Primary Examiner*—Thomas Denion
*Assistant Examiner*—Kyle Riddle
(74) *Attorney, Agent, or Firm*—Birch, Stewart, Kolasch & Birch, LLP

(57) ABSTRACT

To provide a cam phase variable apparatus, which can suppress the occurrence of play from abrasion at sliding portions of two rotatable members, which rotate relative to each other, to allow good accuracy in phase control to be kept over a long period of time without complicating the structure of the two rotatable members. A cam phase variable apparatus for varying the phase of a cam which is driven by power of a crankshaft includes a lever supported for rocking motion on a support shaft provided on an outer shaft, and a driving apparatus for rocking the lever. The driving apparatus includes a transmission member, which is driven to rotate by an electric motor, and an operation member which moves in an axial direction together with the transmission member. The lever has a first operating arm having a pin for engaging with the operation member, and a second operating arm having a roller for engaging with a cam tube on which the cam is formed. The lever for transmitting the power of the crankshaft to the cam tube provides relative rotation between the outer shaft and the cam tube, when it is rocked through the operation member, to vary the phase of the fuel cam with respect to the crankshaft.

20 Claims, 14 Drawing Sheets

CAM PHASE VARIABLE APPARATUS

CROSS-REFERENCE TO RELATED APPLICATIONS

This non-provisional application claims priority under 35 U.S.C. § 119(a) on Patent Application Nos. 2001-240269 and 2001-390981 filed in Japan on Aug. 8, 2001 and Dec. 25, 2001, respectively. The entirety of each of the above applications is hereby incorporated by reference.

BACKGROUND OF THE INVENTION

1. Field of the Invention

The present invention relates to a cam phase variable apparatus for varying the phase of a cam, which is driven to rotate by power of a driving rotary shaft in order to make it possible to control the operation timing of an object of operation by the cam with respect to the driving rotary shaft. More particularly, the present invention relates to a cam phase variable apparatus for varying, for example, the injection timing of a fuel injection apparatus or an opening or closing timing of an intake valve or an exhaust valve, which is operated by a cam driven to rotate by power of a crankshaft of an internal combustion engine.

2. Description of Background Art

Conventionally, one cam phase variable apparatus of the type mentioned is disclosed in the official gazette of, for example, Japanese Patent Publication No. Sho 63-30496. The cam phase variable apparatus is provided for a fuel injection apparatus of an internal combustion engine and includes a pair of helical gears having helical splines cut in the opposite directions to each other and provided on a driving shaft. A camshaft has a cam provided thereon for being driven to rotate by the driving shaft to operate a fuel control valve. Furthermore, a sleeve is held in meshing engagement with the helical gears. The sleeve is moved in an axial direction through a slip ring, which is driven to move in an axial direction by an actuator, such as an electric motor, to rotate the cam shaft and the driving shaft relative to each other to vary the phase between the cam shaft and the driving shaft. Thereby, the operation timing of the fuel control valve with respect to the driving shaft, i.e., the fuel injection timing, is varied.

Another cam phase variable apparatus as a valve timing adjustment apparatus for intake and exhaust valves of an internal combustion engine is disclosed in the official gazette of Japanese Patent Laid-Open No. Hei 11-223113. In the cam phase variable apparatus, a hydraulic chamber formed in a timing pulley driven to rotate by a crankshaft is partitioned into a delay angle hydraulic chamber and a lead angle hydraulic chamber by a vane member formed integrally with a camshaft. The vane member is rotated relative to the timing pulley by hydraulic pressure of operating oil supplied into or discharged from the delay angle hydraulic chamber and the lead angle hydraulic chamber to vary the phase of the cam shaft relative to the crankshaft. Thereby, the opening and closing timings of the intake and exhaust valves with respect to the crankshaft is varied.

Incidentally, in the cam phase variable apparatus which uses the helical gear, abrasion of the splines of the sleeve and the helical gears is liable to occur through contact between the splines when movement in an axial direction of the sleeve driven by the actuator is converted into relative rotation of the cam shaft and the driving shaft by the helical gears. Furthermore, because of play arising from the abrasion, it is difficult to keep good control accuracy of the cam phase with respect to the driving shaft over a long period of time.

In addition, in the cam phase variable apparatus, which uses the vane member driven hydraulically, it is necessary to form a hydraulic chamber or an oil path in the timing pulley and the camshaft. Furthermore, it is necessary to provide the timing pulley with a seal apparatus for keeping the operating oil in the hydraulic chamber in a high hydraulic pressure state. Thus, there is a drawback in that the timing pulley and the camshaft are very complicated in structure.

SUMMARY OF THE INVENTION

The present invention has been made in view of such a situation as described above. It is a common object of the present invention to provide a cam phase variable apparatus which can suppress the occurrence of play by abrasion at sliding portions of two rotatable members, which rotate relative to each other, to allow good accuracy in phase control to be kept over a long period of time without complicating the structure of the two rotatable members.

Furthermore, it is an object of the present invention to decrease the inertial mass of components of a cam phase variable apparatus which rotate together with a first rotatable member to suppress degradation of the responsibility of rotation of a cam to a driving rotary shaft.

Furthermore, it is an object of the present invention to achieve further augmentation of the accuracy in phase control and to achieve a further reduction in size of a cam phase variable apparatus in an axial direction.

According to a first aspect of the present invention, a cam phase variable apparatus is provided for rotating a driving side member formed from a driving rotary shaft or a rotatable member driven to rotate by power of the driving rotary shaft. A cam side member is formed from a cam driven to rotate by the power of the driving rotary shaft or a rotatable member rotated in synchronism with the cam relative to each other in order to vary the phase of the cam with respect to the driving rotary shaft. A support shaft is provided on a first rotatable member and is formed from one of the driving side member and the cam side member. A lever is supported for rocking motion around a center axial line on a plane intersecting with an axial line of rotation of the first rotatable member. A driving apparatus is provided for rocking the lever. The lever has a first operating arm for engaging with the driving apparatus and a second operating arm for engaging with a second rotatable member formed from the other of the driving side member and the cam side member. Furthermore, the lever transmits the power of the driving rotary shaft to the cam side member and provides relative rotation between the first rotatable member and the second rotatable member which commonly have the axial line of rotation when the lever is rocked by the driving apparatus.

According to the first aspect of the present invention, the phase of the cam with respect to the driving rotary shaft is varied when the lever supported for rocking motion on the first rotatable member through the support shaft and engaging at the second operating arm thereof with the second rotatable member is rocked by the driving apparatus, which engages with the first operating arm of the lever to provide relative rotation between the first rotatable member and the second rotatable member. As a result, the following effects are achieved. In particular, the lever supported for rocking motion on the support shaft can smoothly convert, through the rocking motion thereof, the driving force of the driving apparatus acting upon the first operating arm into a force acting in a direction in which the relative rotation is provided. Accordingly, the occurrence of abrasion at sliding portions on which the lever slides such as the support shaft and the engaging portion of the second rotatable member is suppressed, and good accuracy in phase control can be maintained over a long period of time. Furthermore, the relative rotation is performed through the lever, which is supported for rocking motion on the support shaft secured to the first rotatable member and engages with the engaging portion of the second rotatable member. This is different from the background art described hereinabove, wherein such relative rotation is provided making use of hydraulic pressure. Accordingly, the necessity for a seal apparatus and so forth is eliminated. Consequently, the structure of the first rotatable member and the second rotatable member can be made comparatively simple.

According to a second aspect of the present invention, the second operating arm and the second rotatable member engage with each other through contact of a spherical face of an engaging portion of one of the second operating arm and the second rotatable member with an engaging portion of the other of the second operating arm and the second rotatable member in a circumferential direction.

According to the second aspect of the present invention, the following effect is exhibited. In particular, the engagement between the second operating arm of the lever and the second rotatable member is performed through the contact in a circumferential direction between the spherical face of one of the second operating arm and the second rotatable member and the engaging portion of the other of the second operating arm and the second rotatable member. Accordingly, abrasion at the engaging portions by sliding movement is suppressed, and good accuracy in phase control can be maintained over a long period of time.

According to a third aspect of the present invention, the driving apparatus includes a first driving portion having a movable portion provided coaxially with the first rotatable member and movable in an axial direction with respect to the first rotatable member and a second driving portion having a driving force generation member for causing the movable portion to move in the axial direction. The movable portion has a transmission member movable in the axial direction and rotatable with respect to the first rotatable member and an operation member rotatable with respect to the transmission member and movable in the axial direction together with the transmission member. The transmission member is moved in the axial direction by the driving force generation member, whereas the operation member engages with the first operating arm.

According to the third aspect of the present invention, the following effects are exhibited. In particular, only the operating member, which engages with the first operating arm rotates together with the first rotatable member from among those members which compose the driving apparatus. Accordingly, the inertial mass of the components of the cam phase variable apparatus which rotate together with the first rotatable member can be reduced to suppress the degradation of the responsibility of rotation of the cam to a variation of the speed of rotation of the driving rotary shaft. Furthermore, the loss of power for driving the driving rotary shaft to rotate can be reduced. Furthermore, since the movable portion is provided coaxially with the first rotatable member, the movable portion can be disposed compactly in a diametrical direction of the first rotatable member.

According to a fourth aspect of the present invention, a driven member, which rotates together with the transmission member and to which the rotational driving force from the driving force generation member is transmitted, is provided on the transmission member formed from a cylindrical member. A threaded portion for meshing with a threaded portion provided at a fixed portion of the first driving portion to move the transmission member in the axial direction upon rotation of the transmission member is formed on a circumferential face of the transmission member.

According to the fourth aspect of the present invention, the following effect is exhibited. In particular, the transmission member rotated by the rotating driving force transmitted from the driving force generation member through the driven member has the threaded portion which meshes with the threaded portion of the fixed portion. Accordingly, a reactive force and an assisting force acting upon the cam from the member driven by the cam and transmitted to the movable portion are intercepted by the threaded portions and do not act upon the driving force generation member. Consequently, occurrence of an increase or decrease of the control load acting upon the driving force generation member is prevented and degradation of the accuracy in phase control is prevented.

According to a fifth aspect of the present invention, the support shaft is positioned in an internal space of the transmission member and disposed such that the support shaft and the transmission member overlap with each other as seen from the direction perpendicular to the axial direction.

According to the fifth aspect of the present invention, the following effects are exhibited. In particular, the support shaft is disposed making use of the inner space of the cylindrical transmission member inwardly of the transmission member. Accordingly, an increase in size of the movable portion and hence of the cam phase variable apparatus in a diametrical direction can be suppressed. Furthermore, since the support shaft and the transmission member are disposed such that they overlap with each other as seen from the direction perpendicular to the axial direction, the movable portion and hence the cam phase variable apparatus can be miniaturized in the axial direction.

According to a sixth aspect of the present invention, a stroke sensor for detecting an amount of movement of the movable portion in the axial direction is provided, and a control apparatus for controlling the driving force generation member based on a detection signal of the stroke sensor is provided.

According to the sixth aspect of the present invention, the following effect is exhibited. In particular, the operation member of the movable portion, which moves in the axial direction, rocks the lever to provide relative rotation between the first rotatable member and the second rotatable member. Accordingly, a phase variation amount of the cam is detected by the stroke sensor. Then, since the control apparatus controls the driving force generation member based on a result of the detection, the accuracy in phase control can be augmented.

According to a seventh aspect of the present invention, the driving force generation member is an electric motor. The electric motor is disposed such that a rotary axis thereof and the first rotary member extend in parallel to each other and overlap with each other as seen from the direction perpendicular to the axial direction.

According to the seventh aspect of the present invention, the following effect is exhibited in addition to the effects of the invention as set forth in the claims referred to. In particular, since the electric motor is disposed such that the rotary shaft thereof extends in parallel to and overlaps as seen from the direction perpendicular to the axial direction with the first rotatable member, the cam phase variable apparatus can be miniaturized in the axial direction.

It should be noted that, in the present specification, an axial direction signifies the direction of an axial line of rotation of a first rotatable member (in the embodiments, for example, an outer shaft or a camshaft). A diametrical direction and a circumferential direction signify a diametrical direction and a circumferential direction of the first rotatable member, respectively.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

In the following, embodiments of the present invention will be described with reference to the accompanying drawings.

Figure 1:
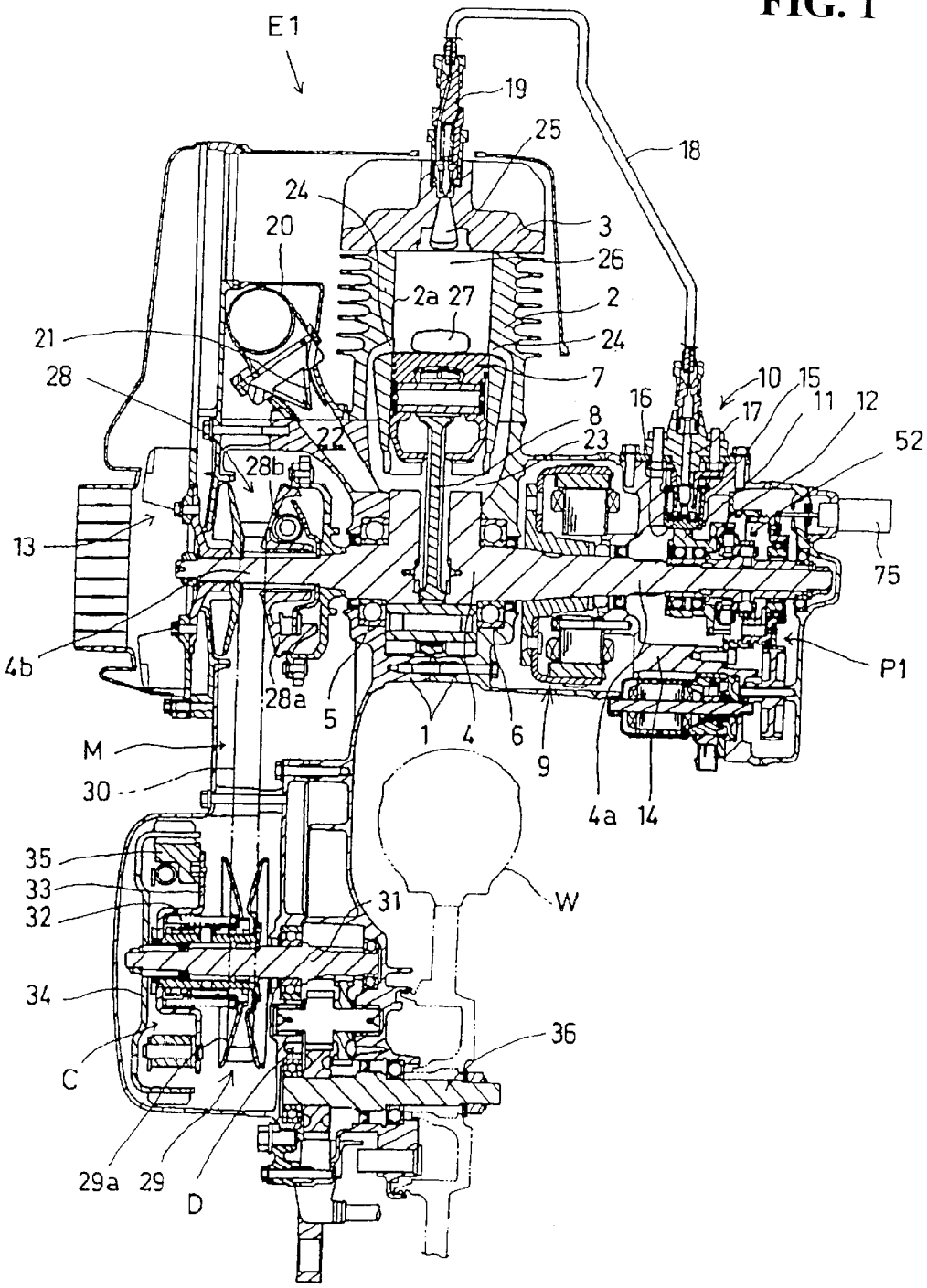
FIG. 1 shows a first embodiment of the present invention and is a vertical sectional view of a 2-cycle internal combustion engine of the compression ignition type having a fuel injection apparatus to which a cam phase variable apparatus is applied.

FIGS. 1 to 8 illustrate a first embodiment of the present invention, wherein a cam phase variable apparatus is applied to a fuel injection pump of a fuel injection system used for an internal combustion engine of the compression ignition type. Referring to FIG. 1, a motorcycle (not shown) includes an internal combustion engine E1, which is an air-cooled single cylinder 2-cycle internal combustion engine of the compression ignition type. The engine E1 includes a power transmission apparatus including a belt type automatic transmission M, a start clutch C and a reduction gear D.

The internal combustion engine E1 includes a leftwardly and rightwardly split crankcase 1. A cylinder 2 and a cylinder head 3 are successively placed on the crankcase 1 and are coupled integrally with each other by means of bolts. A crankshaft 4 is disposed horizontally on a vehicle body such that it is directed in the leftward and rightward direction. The crankshaft 4 is supported for rotation on the crankcase 1 through a pair of left and right main bearings 5 and 6. A piston 7 is fitted for sliding movement in a cylinder bore 2*a* formed in the cylinder 2 and is connected to the crankshaft 4 through a connecting rod 8.

It should be noted that, in the present specification, the terms "front," "back," "left" and "right" signify the front, back, left and right with reference to the motorcycle from the perspective of a driver.

At a right end portion 4*a* of the crankshaft 4, which projects rightwardly of the right main bearing 6, an AC generator 9, a cam tube 12 and a cam phase variable apparatus P1 for varying the phase of the fuel cam 11 with respect to the crankshaft 4 are provided. A fuel cam 11 for driving a fuel injection pump 10 is formed rightwardly of the AC generator 9 on the cam tube 12. At a left end portion 4*b* of the crankshaft 4 which projects leftwardly of the left main bearing 5, a driving pulley 28 of the automatic transmission M and a cooling fan 13 for pressure feeding cooling air leftwardly of the driving pulley 28 are provided.

The fuel injection pump 10 is mounted on a casing 14, which serves also as a cover for the AC generator 9. The fuel injection pump 10 is operated by the fuel cam 11 which is driven to rotate by power of the crankshaft 4 which serves as a driving rotary shaft. The fuel cam 11 lifts a plunger 17 through a lifter 16 which is biased by a return spring 15 to contact with the fuel cam 11 to compress fuel. The compressed fuel passes through a fuel pipe 18 and is injected from a fuel injection valve 19. Therefore, the fuel injection starting timing is determined in accordance with the phase of the fuel cam 11 with respect to the crankshaft 4. Furthermore, the cam phase variable apparatus P1 varies the phase of the fuel cam 11 non-stepwise in response to an engine operation state such as the speed of the engine to control the fuel injection starting timing.

An intake port 22 for introducing air taken in from an intake pipe 20 through a lead valve 21 into a crank chamber 23 is formed in the crankcase 1. Air compressed in the crank chamber 23 during a downward stroke of the piston 7 is supplied into the cylinder bore 2*a* through a scavenge port 24 which is formed in the crankcase 1 and the cylinder 2 and is open to the cylinder bore 2*a*. In the final stage of an upward stroke of the piston 7, the fuel injected into an auxiliary chamber 25 formed in the cylinder head 3 from the fuel injection valve 19 mounted on the cylinder head 3 is then brought into contact with compressed air of a high temperature and a high pressure and is burned with the compressed air. Thereafter, combustion proceeds also in a main combustion chamber 26 formed between the cylinder head 3 and the piston 7, and the piston 7 is moved down by the pressure of generated combustion gas to drive the crankshaft 4 to rotate. After expansion, the combustion gas then flows out from an exhaust port 27 into an exhaust pipe (not shown) by pressure of the combustion gas itself. The exhaust port 27 is opened in the latter half of a downward stroke of the piston 7. Furthermore, the scavenging action of fresh air which flows in through the scavenge port 24, which is opened when the piston 7 moves further down.

The power transmission apparatus will now be described. The centrifugal automatic transmission M includes the driving pulley 28 of a variable diameter, which rotates integrally with the crankshaft 4. A driven pulley 29 is provided for rotation on a driven shaft 31. An endless belt 30 is formed from a V-belt extending between and around the two pulleys 28 and 29. The diameter of the driving pulley 28 is varied as a plurality of weight rollers 28*b*, which move in a diametrical direction by the centrifugal force, move a movable face 28*a* of the driving pulley 28 along the crankshaft 4. In response to the variation of the diameter of the driving pulley 28, a movable face 29*a* of the driven pulley 29 moves along the driven shaft 31 against the spring force of a compression spring 32 thereby to vary the diameter of the driven pulley 29. In this manner, the reduction gear ratio of the automatic transmission M automatically decreases as the speed of rotation of the engine increases.

The centrifugal start clutch C is disposed on the rear wheel W side (which is a driving wheel) with respect to the automatic transmission M in the power transmission system and is brought into a connection state when the speed of rotation of the engine exceeds a predetermined value and a plurality of clutch shoes 35 are rocked in a diametrically outer direction by the centrifugal force so that they are brought into contact with an inner circumferential face of a clutch outer member 34, which rotates integrally with the driven shaft 31. The plurality of clutch shoes 35 are supported for rocking motion on a drive plate 33, which rotates integrally with the driven pulley 29. Furthermore, the driven shaft 31 is connected to a rear axle 36, on which the rear wheel W is mounted, through the reduction gear D formed from a gear train.

Consequently, the power of the internal combustion engine E1 is transmitted from the crankshaft 4 through the automatic transmission M, start clutch C and reduction gear D to the rear wheel W so that the rear wheel W is driven to rotate.

Figure 2:
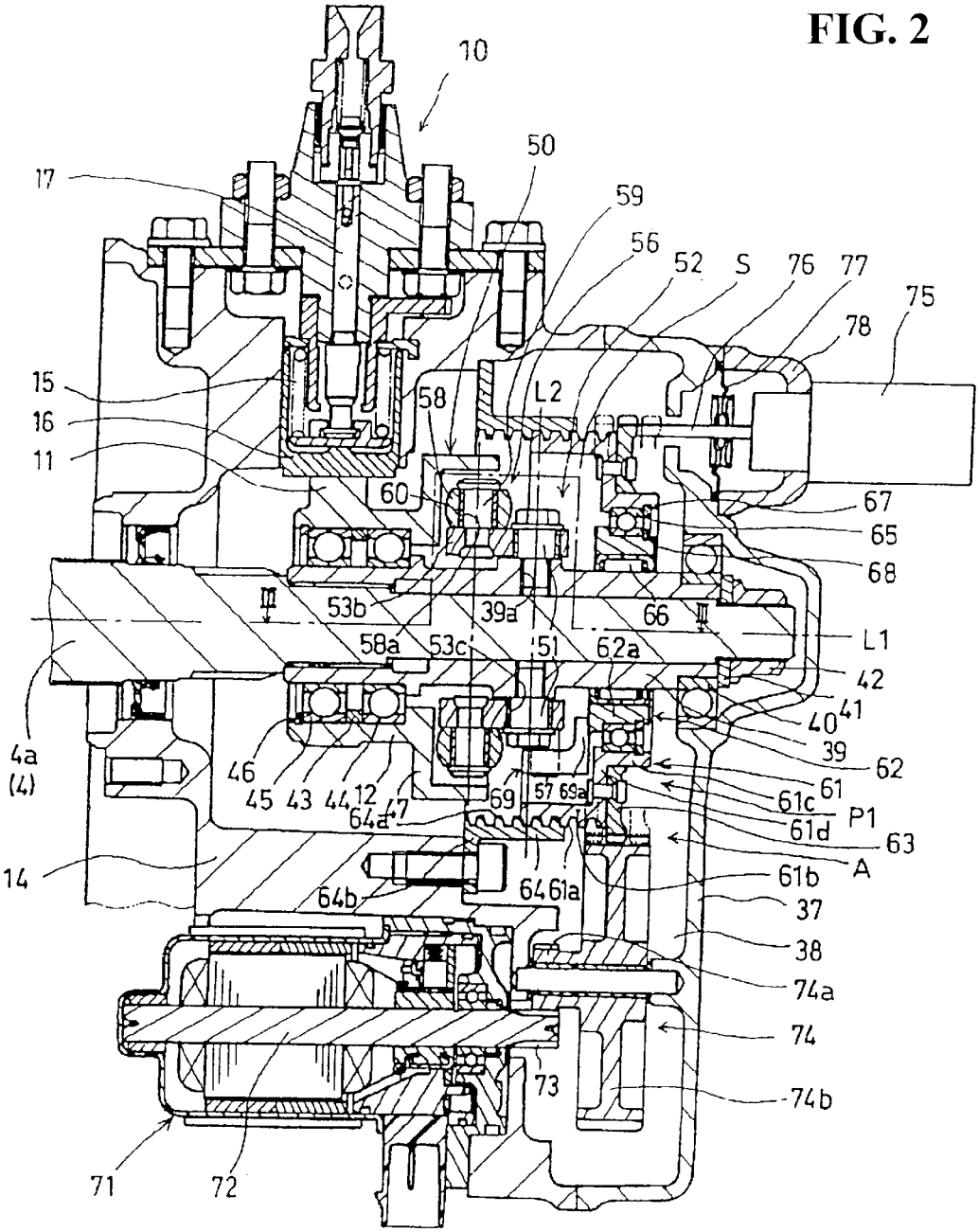
FIG. 2 is an enlarged view of essential part of FIG. 1.

Referring to FIG. 2, the cam phase variable apparatus P1 is accommodated in an accommodation chamber 38 formed by the casing 14 fastened to the crankcase 1 by means of bolts and a cover 37 fastened to the casing 14 by means of bolts.

An outer shaft 39 is spline fitted with an outer circumference of the right end portion 4*a* of the crankshaft 4 and driven to rotate by the power of the crankshaft 4 in synchronism with the crankshaft 4, i.e., in a normally fixed phase with respect to the crankshaft 4. The outer shaft 39 has a rotational axial line L1 the same as the crankshaft 4 and is supported at a right end portion thereof for rotation on the cover 37 together with the crankshaft 4 through a ball bearing 40 supported on the cover 37. Movement of the outer shaft 39 in an axial direction is prevented by a nut 42 screwed at a right end portion of the crankshaft 4 through a washer 41 with which end faces of the outer shaft 39 and the ball bearing 40 in the axial direction contact.

The cylindrical cam tube 12 is supported at a left end portion of the outer shaft 39 for rotation with respect to the outer shaft 39 by a pair of ball bearings 44 and 45. The ball bearings 44 and 45 are force fitted on an outer circumference of the outer shaft 39 contiguously with a spacer 43 interposed therebetween. Therefore, the cam tube 12 is a rotatable member, which rotates in synchronism with the fuel cam 11, i.e., in a normally fixed phase. It should be noted that movement of the cam tube 12 in an axial direction is prevented by a shouldered portion of the cam tube 12 with which the ball bearing 44 contacts and a snap ring 46 mounted on the cam tube 12 in a contacting relationship with the other ball bearing 45.

Figure 3:
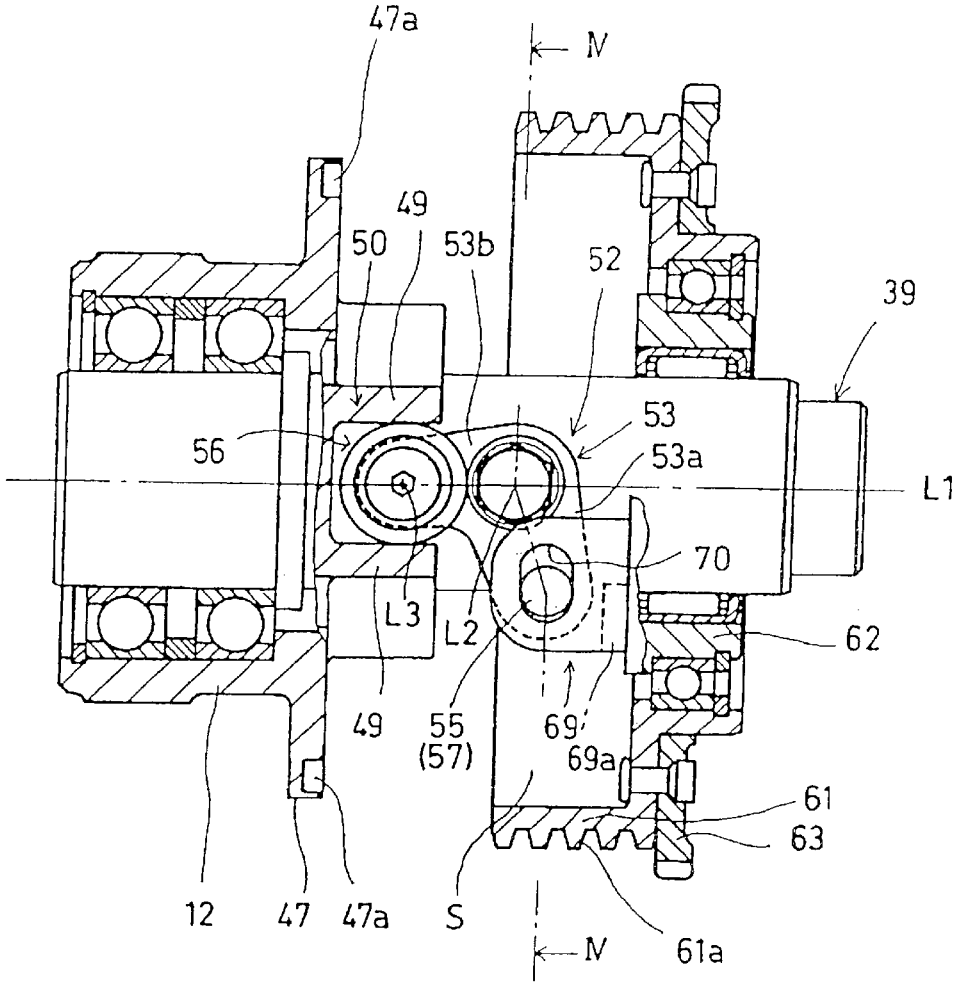
FIG. 3 is a sectional view taken along line III—III of FIG. 2 showing essential part of the cam phase variable apparatus in an initial position.
Figure 4:
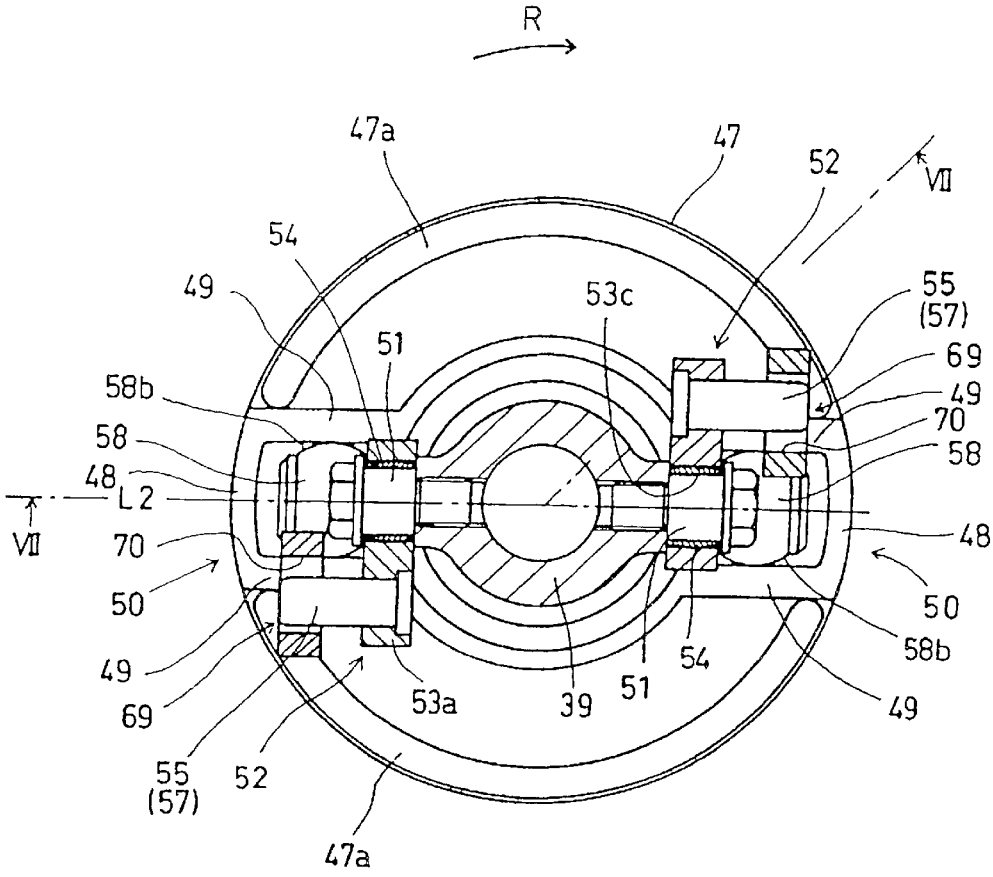
FIG. 4 is a sectional view taken along line IV—IV of FIG. 3.

Referring also to FIGS. 3 and 4, a flange 47 in the form of a disk and a pair of engaging portions 50 positioned in an opposing relationship to each other in a diametrical direction of the flange 47 are formed integrally with the cam tube 12 at a right end portion of the cam tube 12. Each of the engaging portions 50 is formed as an accommodation chamber, which is defined by the flange 47, an outer circumferential wall 48 projecting in an axial direction from the flange 47 and a pair of circumferential walls 49 opposed to each other in a circumferential direction. The accommodation chamber is open to the center bolts 51 side, which will be hereinafter described, inwardly and in an axial direction. At edge portions of an outer circumference on the movable portion side, which is a side face in an axis direction of the flange 47, a pair of arcuate grooves 47*a* are formed between the pair of engaging portions 50. A setting shaft 79 is fitted into each of the pair of arcuate grooves 47*a*.

The cam phase variable apparatus P1 includes a pair of levers 52 of the same shape supported on the center bolts 51 serving as a support shaft and secured at positions opposing to the outer shaft 39 in a diametrical direction and disposed in a symmetrical relationship to a point provided by the rotational axial line L1 as viewed in an axial direction. A driving apparatus A is provided for rocking the levers 52. Each of the levers 52 is supported through a bush 54 on a center bolt 51 screwed in and secured to a threaded hole 39*a* of the outer shaft 39 for rocking motion around a center axial line L2 perpendicular to the rotational axial line L1.

Each of the levers 52 is formed from a body 53 having a first arm 53*a* and a second arm 53*b* extending in different diametrical directions with respect to the center axial line L2 and a through-hole 53*c* into which a bush 54 is force fitted, and a pair of engaging portions 55 and 56 provided at end portions of the first and second arms 53*a* and 53*b*, respectively. In the present embodiment, the body 53 has a substantially L-shape as viewed in a direction of the center axial line L2 since the angle defined by the arms 53*a* and 53*b* with respect to the center axial line L2 is set substantially to 90° (refer to FIG. 3).

The engaging portion 55 is formed from a cylindrical pin 57 force fitted in and secured to a through-hole at an end portion of the first arm 53*a* and inserted in an elongated hole 70 of an engaging portion 69 formed on an operation member 62. The operation member 62 is a component of the driving apparatus A. The first arm 53*a* and the engaging portion 55 form a first operating arm.

The engaging portion 56 is formed from a roller 58, a pin 59, and a bush 60. The roller 58 is accommodated in the engaging portion 50 of the cam tube 12. The pin 59 has a head portion for preventing removal of the roller 58 and is inserted in and secured by caulking to an end portion of the second arm 53*b*. The bush 60 is force fitted in a through-hole 58*a* formed in the roller 58 for supporting the roller 58 for rotation on the pin 59 and has the pin 59 inserted therein. The second arm 53*b* and the engaging portion 56 form a second operating arm. An outer circumferential face 58*b* of the roller 58 is formed from a spherical face, and the opposite end faces of the roller 58 in an axial direction of the pin 59 are formed as flat faces. A rotational axial line L3 of the roller 58, which is the center axial line also of the roller 58, and the pin 59 exists on a plane which includes the rotational axial line L1 and the center axial line L2 in an initial position of the cam phase variable apparatus P1, which is a position shown in FIGS. 2 to 4. The roller 58 in a state wherein it is accommodated in the engaging portion 50 then normally contacts at the outer circumferential face 58*b* thereof with an inner face of the circumferential wall 49. Consequently, power of the crankshaft 4 is transmitted to the cam tube 12 through the outer shaft 39, center bolts 51 and levers 52. The cam tube 12 is driven to rotate by the power of the crankshaft 4.

Referring to FIG. 2, the driving apparatus A includes a first driving portion disposed coaxially with the crankshaft 4, and a second driving portion having an electric motor 71 serving as a driving force generation member and a reduction gear 74 serving as a reduction gear mechanism for transmitting rotation of the electric motor 71 with a reduced speed to the first driving portion. The first driving portion has a movable portion connected to the reduction gear 74 to be driven thereby. The movable portion is mounted coaxially with the crankshaft 4 and the outer shaft 39 for movement in an axial direction with respect to the outer shaft 39. A fixed portion of the first driving portion is secured to the casing 14.

The movable portion includes a cylindrical transmission member 61 having an axial line of rotation on the rotational axial line L1. An operation member 62 is positioned inwardly of the transmission member 61 and is mounted for pivotal motion with respect to the transmission member 61 and for movement in an axial direction together with the transmission member 61. A driven gear 63 is provided on the transmission member 61 and serves as a driven gear 63. The fixed portion is formed from a cylindrical guide member 64 positioned outwardly of the transmission member 61 in a diametrical direction and secured at a flange 64*b* thereof to the casing 14 by means of a bolt such that it has a center axial line on the rotational axial line L1. A female threaded portion 64*a* in the form of a trapezoidal screw is formed on an inner circumferential face of the guide member 64.

The transmission member 61 has a large diameter portion 61*b* having on an outer circumferential face thereof a male threaded portion 61*a* in the form of a trapezoidal screw for meshing with the female threaded portion 64*a*. A small diameter portion 61*c* connecting to the large diameter portion 61*b* through an offset portion 61*d* is formed in a diametrical direction and has an outer diameter and an inner diameter both smaller than the large diameter portion 61*b*. The driven gear 63 is fitted on an outer circumference of the small diameter portion 61*c* positioned at an end portion in an axial direction of the transmission member 61 and secured to the small diameter portion 61*c* by means of rivets so that it may rotate integrally with the transmission member 61. The driven gear 63 has a diameter greater than the large diameter portion 61*b* and meshes with a large gear 74*b* of the reduction gear 74.

A ball bearing 65 is provided between an inner circumferential face of the small diameter portion 61*c* of the transmission member 61 and an outer circumferential face of a cylindrical portion 62*a* of the operation member 62 disposed inwardly of the small diameter portion 61*c*. A needle bearing 66 is provided between an inner circumferential face of the cylindrical portion 62*a* and an outer circumferential face of the outer shaft 39. Consequently, the transmission member 61 and the operation member 62 are supported for rotation relative to the outer shaft 39, and the operation member 62 is supported for rotation relative to the transmission member 61. The operation member 62 is movable in an axial direction integrally with the transmission member 61 on and relative to the outer shaft 39 by a pair of snap rings 67 and 68 for preventing a movement of the ball bearing 65 in the axial direction.

Referring also to FIGS. 3 and 4, a pair of engaging portions 69 each having a supporting wall 69*a* extending and projecting in a diametrical direction and extending in an axial direction on the end side of the supporting wall 69*a* in an inner space S of the large diameter portion 61*b* are formed at the center bolt 51 side of the operation member 62. The engaging portions 69 are so shaped that they are symmetrical with respect to a point at the rotational axial line L1 as viewed in an axial direction (refer to FIG. 4). An elongated hole 70 into which a pin 57 is inserted is formed in each of the engaging portions 69. The center bolts 51 are positioned in the inner space S inwardly of the transmission member 61 within a range of movement of the transmission member 61 in the axial direction such that they overlap with the transmission member 61 as seen from the direction perpendicular to the axial direction.

Referring to FIG. 2, the electric motor 71 is secured to the casing 14 by means of bolts and has a rotary shaft 72 parallel to a rotational axial line L1 of the crankshaft 4 and the outer shaft 39. The rotary shaft 72 is overlapped to the outer shaft 39 as seen from the direction perpendicular to the axial direction of the rotary shaft 72. An end portion of the rotary shaft 72 forms a driving gear 73. The driving gear 73 meshes with a small gear 74*a* of the reduction gear 74 on which the small gear 74*a* and the large gear 74*b* are formed integrally. The large gear 74*b* meshes with the driven gear 63. Consequently, the speed of rotation of the electric motor 71 is reduced in two stages between the driving gear 73 and the small gear 74*a* and between the large gear 74*b* and the driven gear 63.

A stroke sensor 75 formed from a displacement sensor such as, for example, a potentiometer for detecting the amount of movement of the movable portion described hereinabove in the axial direction, that is, the stroke amount of the movable portion is provided on the cover 37. The stroke sensor 75 has a rod 76 which normally contacts with a side face of the driven gear 63 in an axial direction. A diaphragm 77 is secured to the rod 76 and has an outer peripheral edge portion held between the cover 37 and a holding member 78 which holds the stroke sensor 75 such that it serves also as a seal member. The stroke amount detected by the stroke sensor 75 corresponds to the phase variation amount of the cam tube 12, which is rotated relative to the outer shaft 39 by the levers 52.

A detection signal from the stroke sensor 75 is inputted to an electronic control device (not shown). The electronic control device controls the amount of rotation of the electric motor 71 to control the phase of the cam tube 12 with respect to the crankshaft 4 so that the actual phase amount of the cam tube 12 which is rotated relative to the outer shaft 39 by the levers 52 may coincide with a phase amount set in advance so that an optimum fuel injection starting timing may be obtained in accordance with engine operation states of the internal combustion engine E1 such as a speed of rotation and an applied load.

Incidentally, the cam phase variable apparatus P1 can be assembled at some of the components thereof to the outer shaft 39 and the cam tube 12 to form an assembly part U so that assembly of the cam phase variable apparatus P1 to the internal combustion engine E1 may be facilitated. In the following, an assembly procedure when the assembly part U is used is described with reference to the FIGS. 7 and 8.

First, the bush 54 and the pin 57 (refer to FIG. 4) are assembled to the body 53 of each of the levers 52, and the roller 58 into which the bush 60 is force fitted is inserted into the pin 59. The pin 59 is secured to the second arm 53*b* by caulking. The operation member 62 to which the needle bearing 66 is attached is then inserted from the right end into and assembled to the outer shaft 39. The pin 57 (refer to FIG. 4) secured to the body 53 of each of the levers 52 is the inserted into the elongated hole 70 (refer to FIG. 4) of the engaging portion 69 of the operation member 62. In this state, the lever 52 is pivoted around the outer shaft 39 together with the operation member 62 to register the hole of the left main bearing 5 into which a center bolt 51 of the bush 54 is to be inserted with the threaded hole 39*a* of the outer shaft 39. The lever 52 is the secured to the outer shaft 39 by means of the center bolt 51.

Thereafter, the cam tube 12 is fitted onto the outer shaft 39 with the pair of ball bearings 44 and 45 interposed therebetween. The snap ring 46 is mounted onto the cam tube 12 to fix the cam tube 12 to the outer shaft 39 in the axial direction. In a state wherein the transmission member 61, on which the driven gear 63 and the ball bearing 65 are mounted, meshes with the guide member 64, the two members 61 and 64 are then assembled to the outer shaft 39 from the side remote from the cam tube 12. The transmission member 61 and the operation member 62 are fixed in the axial direction by means of the snap rings 67 and 68.

Thereafter, the setting shaft 79 is inserted into elongated holes 63*a* and 61*e* formed in the driven gear 63 and the offset portion 61*d* until an end portion of the setting shaft 79 contacts with the bottom face of a groove 47*a* of the flange 47. In this state, the setting shaft 79 is turned to rotate the guide member 64 until a first offset portion 79*a* (refer also to FIG. 8) of the setting shaft 79 contacts with the side face of the flange 64*b* of the guide member 64. The guide member 64 is then further rotated until the end face of the large diameter portion 61*b* of the transmission member 61 contacts with a second offset portion 79*b* (refer also to FIG. 8) of the setting shaft 79. In the state wherein the guide member 64 and the transmission member 61 contact with the first and second offset portions 79*a* and 79*b*, a nut 80 is then screwed onto a threaded portion 79*c* of the setting shaft 79 and tightened so that the relative axial positions and positions in the direction of rotation of the levers 52, outer shaft 39, cam tube 12, guide member 64 and transmission member 61 are fixed to the initial positions thereof described hereinabove thereby to obtain the assembly part U.

The assembly part U is assembled to the crankshaft 4 while it remains in the state described above, and thereafter, the guide member 64 is secured to the casing 14 by means of bolts (refer to FIG. 2). The nut 80 is then removed and the setting shaft 79 is rotated, whereupon the contacting states between the first and second offset portions 79*a* and 79*b* and the guide member 64 and transmission member 61 are canceled. The setting shaft 79 is then pulled off from the assembly part U through the elongated holes 63*a* and 61*e* of the driven gear 63 and the offset portion 61*d*. Consequently, the assembly part U is assembled in the state of the initial position described above to the internal combustion engine E1.

In the following, the operation of the cam phase variable apparatus P1 will be described with reference to FIGS. 2 to 6. When the internal combustion engine E1 is operated, the outer shaft 39 is rotated in synchronism with rotation of the crankshaft 4, and the cam tube 12 is rotated through the levers 52 by the outer shaft 39. Then, if it is necessary to advance the fuel injection starting timing to a timing suitable for the operation state of the internal combustion engine E1 with respect to a reference phase between the crankshaft 4 and the fuel cam 11 set in advance, for example, a phase set so that the cam phase variable apparatus P1 may assume the initial position shown in FIGS. 2 to 4, then the electronic control device described above outputs a driving signal for causing the electric motor 71 to rotate by a predetermined amount in order to advance the phase of the fuel cam 11 in a corresponding relationship to a target phase variation amount from the reference phase. Then, the rotation of the rotary shaft 72 of the electric motor 71 is transmitted to the driven gear 63 through the reduction gear 74, and the transmission member 61 integral with the driven gear 63 is moved leftwardly in the axial direction while it is rotated by the feed threaded portion formed from the female threaded portion 64*a* and the male threaded portion 61*a*. Also the operation member 62 is moved leftwardly in the axial direction integrally with the transmission member 61.

Figure 5:
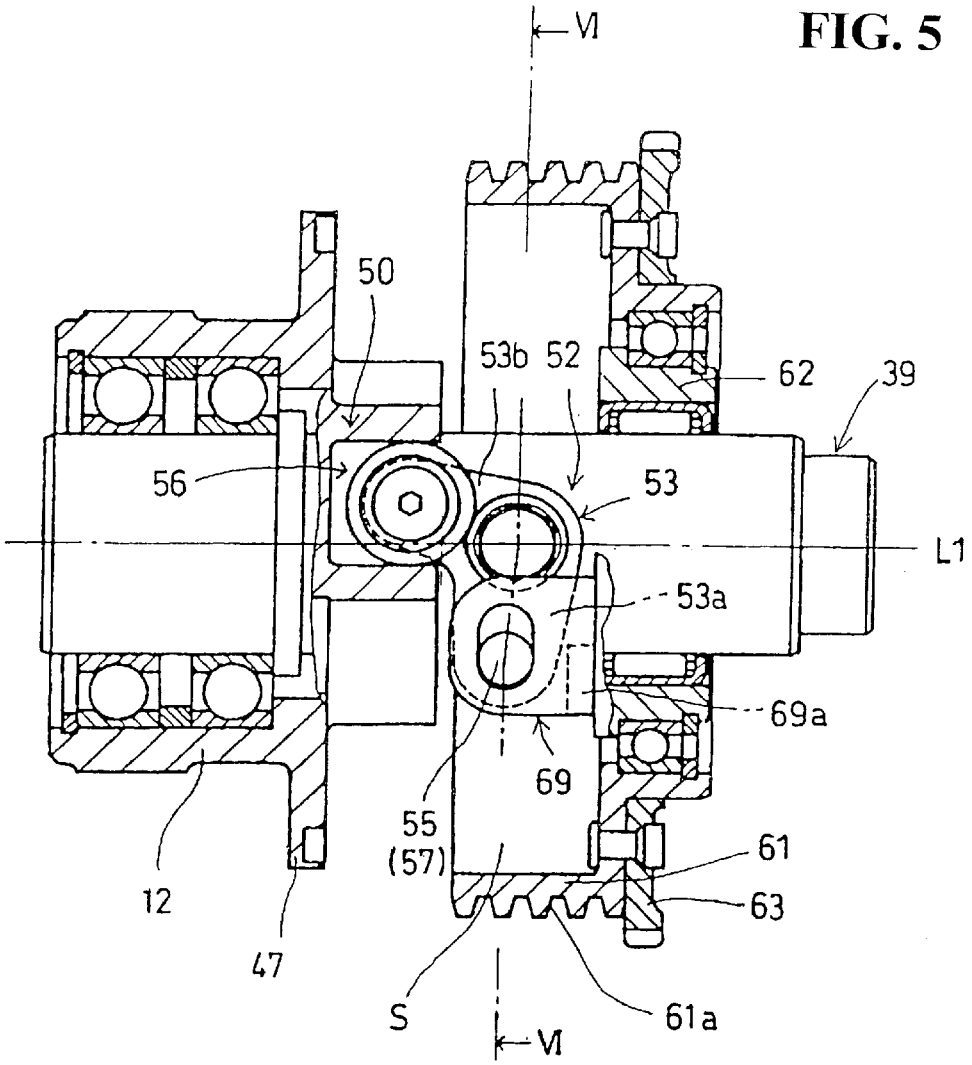
FIG. 5 is a view of the cam phase variable apparatus in an advanced position corresponding to FIG. 3.
Figure 6:
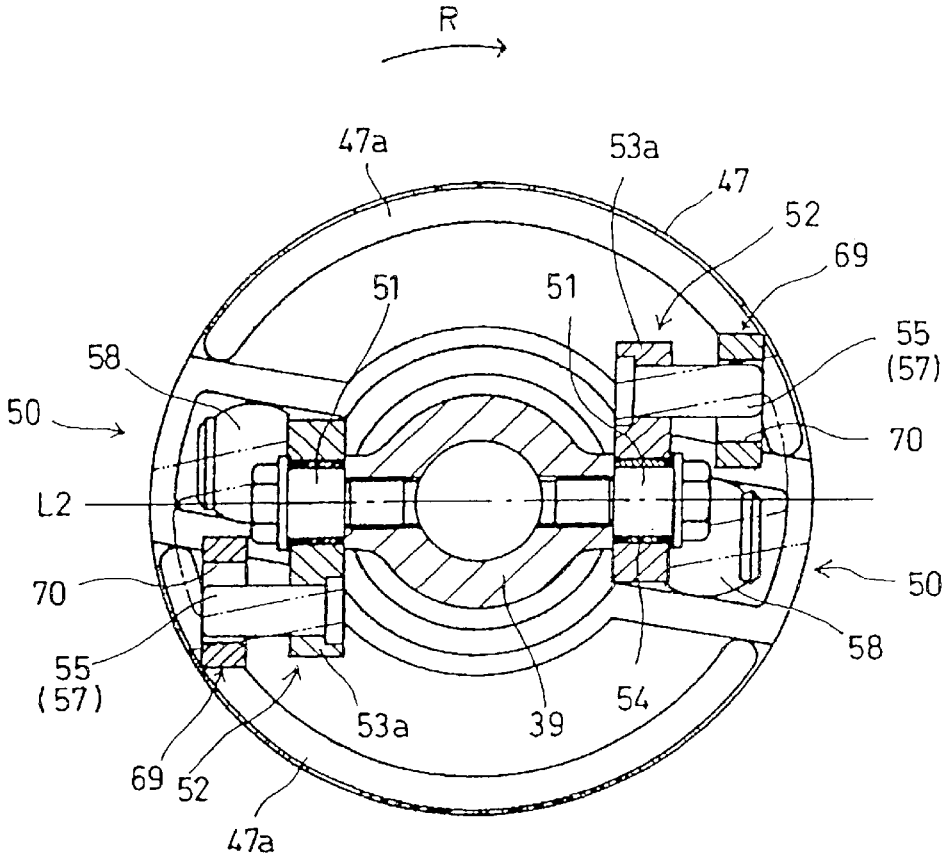
FIG. 6 is a sectional view taken along line VI—VI of FIG. 5.
Figure 7:
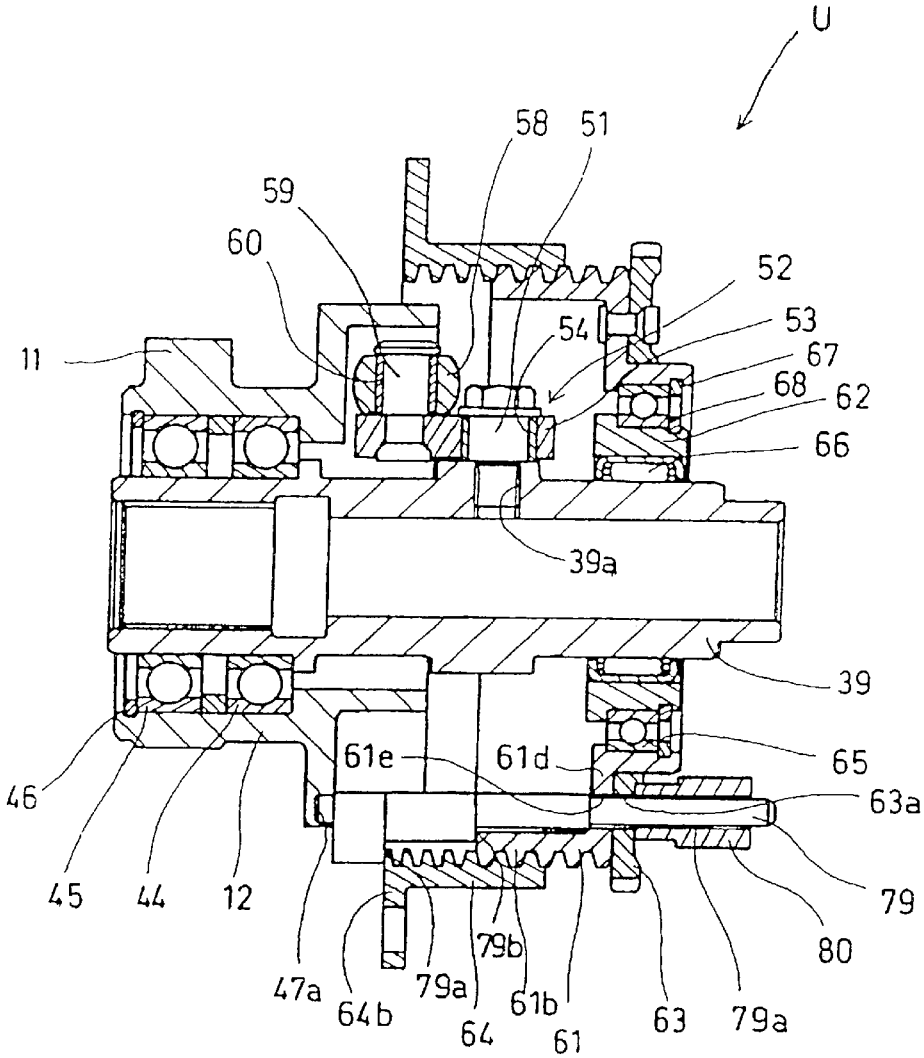
FIG. 7 is a sectional view taken along a plane corresponding to line VII—VII of FIG. 4 where part of the cam phase variable apparatus is formed as an assembly.

Consequently, the operation member 62 presses the cylindrical pin 57 of the first operating arms in the axial direction through the engaging portions 69 with an operation amount proportional to the amount of rotation of the electric motor 71 to rock the levers 52 around the center axial line L2 and the rollers 58 of the engaging portions 56 of the second operating arms press the circumferential walls 49 of the engaging portions 50 of the cam tube 12 in the clockwise direction in FIG. 4. At this time, since the outer shaft 39 is rotating integrally with the crankshaft 4 which is rotating in the rotating direction R, the cam tube 12 is rotated in the clockwise direction in FIG. 4 relative to the outer shaft 39 thereby to vary the phase of the fuel cam 11 with respect to the crankshaft 4 to advance the fuel injection starting timing. Thus, for example, as shown in FIGS. 5 and 6, each of the levers 52 assumes its position rocked from the initial position, and the cam tube 12 assumes a position rotated from the initial position with respect to the outer shaft 39 (in FIG. 2, the position of the driven gear 63 at this time is indicated by an alternate long and short dash line). Then, the phase variation amount at this time is detected by the stroke sensor 75 for detecting the amount of movement of the driven gear 63 in the axial direction, and the actual phase variation amount detected is inputted to the electronic control device. Consequently, the actual phase variation amount is feedback controlled so that it may coincide with the target phase variation amount.

By such feedback control, for example, as the speed of rotation of the engine rises, the fuel injection starting timing can be advanced by a greater angle to make the fuel injection starting timing earlier thereby to improve the combustibility. Furthermore, when it is necessary to delay the fuel injection starting timing in accordance with an operation state of the internal combustion engine E1, the electric motor 71 is rotated in the opposite direction to that upon advancement so that the transmission member 61 and the operation member 62 are moved rightwardly thereby to rotate the cam tube 12 in the opposite direction relative to the outer shaft 39. Consequently, the driven gear 63 assumes a position indicated by an alternate long and two short dashes line in FIG. 2. The cam tube 12 assumes a position rotated in the counterclockwise direction relative to the outer shaft 39, for example, as indicated by an alternate long and two short dashes line in FIG. 6.

The operation and effects of the first embodiment configured in such a manner as described above will now be described. The phase of the fuel cam 11 with respect to the crankshaft 4 is varied when the levers 52 are rocked by the operation member 62 of the driving apparatus A which engages with the first operating arms of the levers 52 to provide relative rotation between the outer shaft 39 and the cam tube 12. The levers 52 are supported for rocking motion on the outer shaft 39 through the center bolts 51 and engage at the second operating arm thereof with the cam tube 12 on which the fuel cam 11 is formed. As a result, the following effects are exhibited. In particular, the levers 52 supported for rocking motion on the center bolts 51 can smoothly convert, through the rocking motion thereof, the driving force of the operation member 62 acting upon the first operating arms into a force acting in a direction in which the relative rotation is provided. Accordingly, the occurrence of abrasion at sliding portions on which the levers 52 slide such as the center bolts 51 and the engaging portions 50 of the cam tube 12 is suppressed, and good accuracy in phase control can be maintained over a long period of time. Furthermore, the relative rotation is performed through the levers 52 which are supported for rocking motion on the center bolts 51 secured to the outer shaft 39 and engaged with the engaging portions 50 of the cam tube 12. Accordingly, the construction is different from the prior art described hereinabove wherein such relative rotation is provided making use of a hydraulic pressure. Furthermore, the necessity for a seal apparatus and so forth is eliminated. Consequently, the structure of the outer shaft 39 and the cam tube 12 can be made comparatively simple.

Furthermore, the engagement between the second operating arm of each of the levers 52 and the cam tube 12 is performed through the contact in a circumferential direction between the outer circumferential face 58*b* formed from a spherical face of the roller 58. The roller 58 is which is a component of the engaging portion 56 of the second operating arm and the pair of circumferential walls 49 which are components of the engaging portion 50 of the cam tube 12. Accordingly, abrasion of the engaging portions 50 and 56 by sliding movement is suppressed, and good accuracy in phase control can be maintained over a long period of time. In addition, the roller 58 is rotatable relative to the pin 59. Accordingly, abrasion by sliding movement is further reduced, and the occurrence of one-sided abrasion wherein only a particular portion is abraded is prevented and the accuracy in phase control is maintained over a longer period of time.

Only the operation member 62 which engages with the first operating arms rotates together with the outer shaft 39 from among those members which compose the driving apparatus A for rocking the levers 52. Accordingly, the inertial mass of the components of the cam phase variable apparatus P1 which rotate together with the outer shaft 39 can be reduced to suppress the degradation of the responsibility of rotation of the fuel cam 11 to a variation of the speed of rotation of the crankshaft 4. Furthermore, the power loss of the internal combustion engine E1 for driving the crankshaft 4 to rotate can be reduced and the fuel cost can be augmented. Furthermore, the movable portion including the transmission member 61 and the operation member 62 is provided coaxially with the outer shaft 39. Accordingly, the movable portion can be disposed compactly in a diametrical direction of the outer shaft 39.

The transmission member 61, which is rotated by the rotating driving force transmitted from the electric motor 71 through the driven gear 63, has a male threaded portion 61*a* which meshes with a female threaded portion 64*a* of the guide member 64. Accordingly, a reactive force and assisting force acting upon the fuel cam 11 through the lifter 16 from the plunger 17 driven by the fuel cam 11 and transmitted to the movable portion are intercepted by the feed screw section formed from the male threaded portion 61*a* and the female threaded portion 64*a* and do not act upon the electric motor 71. Consequently, the occurrence of an increase or decrease of the load acting upon the electric motor 71 is prevented and degradation of the accuracy in phase control is prevented. Furthermore, the female threaded portion 64*a* and the male threaded portion 61*a* are each formed from a trapezoidal screw. Accordingly, rotating motion of the transmission member 61 can be converted into a movement of the operation member 62 in an axial direction with a high degree of accuracy.

The motion direction conversion mechanism for converting the rotating motion of the transmission member 61, which is driven to rotate by the electric motor 71 into a movement in an axial direction of the operation member 62 for rocking the levers 52, is formed from the bearing 65 provided between the transmission member 61 and the operation member 62 and is secured so as to disable a relative movement of the two members 61 and 62 in an axial direction. Accordingly, abrasion of the motion direction conversion mechanism can be reduced and degradation of the accuracy in phase control can be suppressed.

The center bolts 51 are disposed making use of the inner space S of the cylindrical transmission member 61 inwardly of the transmission member 61. Accordingly, an increase in size of the movable portion and hence of the cam phase variable apparatus P1 in a diametrical direction of the transmission member 61 can be suppressed. Furthermore, the center bolts 51 and the transmission member 61 are disposed such that the transmission member 61 is overlapped to the center bolts 51 as seen from the direction perpendicular to the axial direction of the transmission member 61. Accordingly, the movable portion and hence the cam phase variable apparatus P1 can be miniaturized in the axial direction.

The operation member 62 of the movable portion which moves in the axial direction rocks the levers 52 to provide relative rotation between the outer shaft 39 and the cam tube 12. Accordingly, a phase variation amount of the cam is detected by the stroke sensor 75. Furthermore, the electronic control apparatus controls the electric motor 71 based on a result of the detection. Accordingly, the accuracy in phase control can be augmented.

In addition, the electric motor 71 is disposed such that the rotary shaft 72 thereof extends in parallel to the outer shaft 39 and also is overlapped to the outer shaft 39 as seen from the direction perpendicular to the axial direction of the rotary shaft 72. Accordingly, the cam phase variable apparatus P1 can be miniaturized in the axial direction.

The levers 52, guide member 64 and transmission member 61, which are included in the components of the cam phase variable apparatus P1, are assembled to the outer shaft 39 and the cam tube 12 by the setting shaft 79 to form the assembly part U wherein the relative positions thereof in the axial direction or the relative positions thereof in the rotational direction are fixed to the initial positions described above. Accordingly, the assembly performance of the cam phase variable apparatus P1 to the internal combustion engine E1 is augmented.

When the cam phase variable apparatus P1 is in the initial position described above, the center axial line of the roller 58 of the engaging portion of the second operating arm exists on a plane which passes the rotational axial line L1. In addition, the first operating arm and the second operating arm form an angle of approximately 90°. Accordingly a movement in the axial direction of the operation member 62 can be converted into relative rotation efficiently. Consequently, the phase of the cam can be varied over a wide range while the cam phase variable apparatus P1 is miniaturized in the axial direction.

A second embodiment of the present invention will now be described with reference to FIGS. 9 to 14. In the second embodiment, the cam phase variable apparatus of the present invention is applied to a valve motion for an internal combustion engine of the spark ignition type. In the present second embodiment, the cam phase variable apparatus has basically the same configuration as that of the first embodiment. Accordingly, a description of common components is omitted or simplified, and differences are described principally. It should be noted that like members or corresponding members to those of the first embodiment are denoted by like reference characters.

Figure 9:
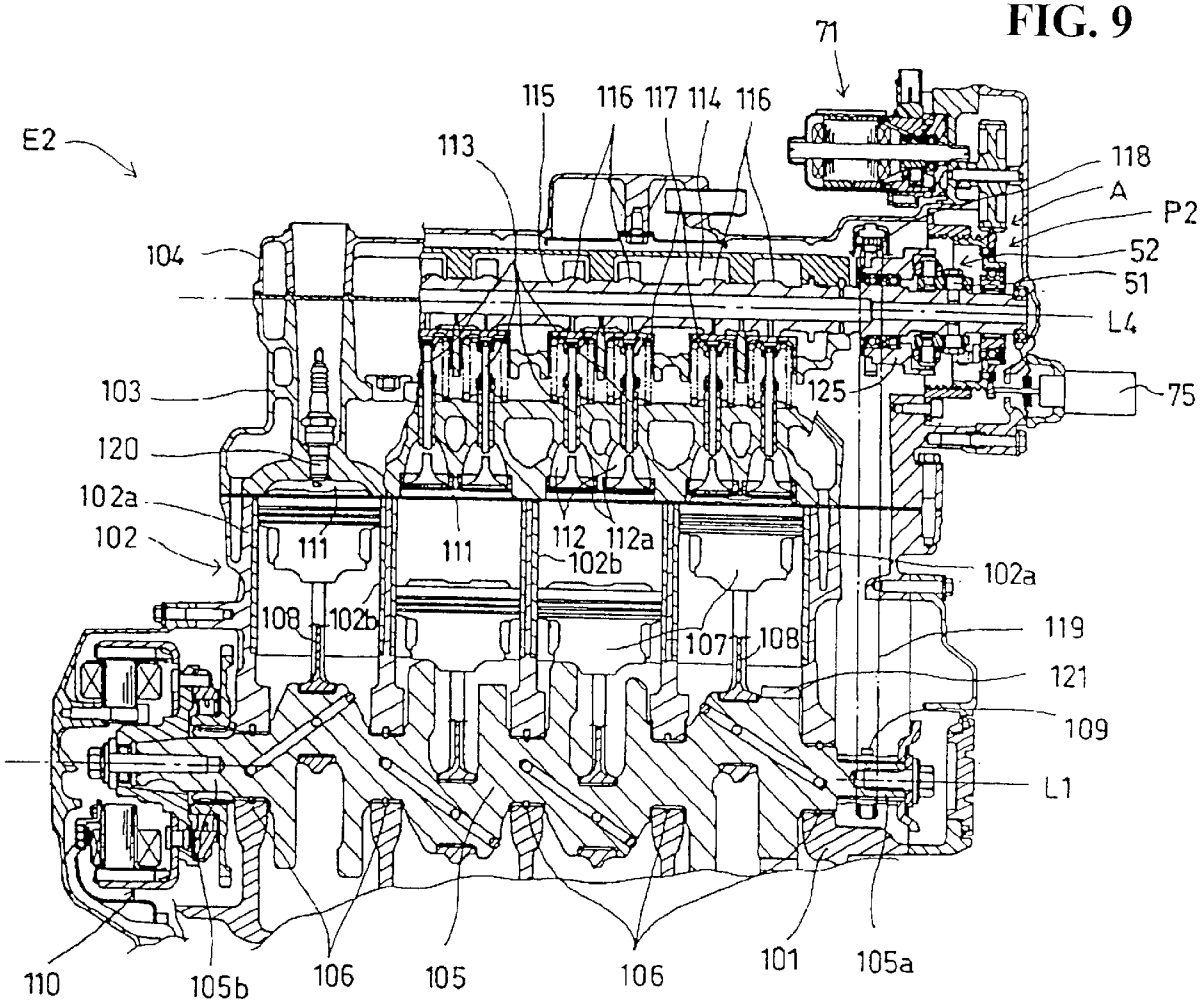
FIG. 9 shows a second embodiment of the present invention and is a vertical sectional view of an internal combustion engine of the spark ignition type having a valve motion to which a cam phase variable apparatus is applied.

Referring to FIG. 9, an internal combustion engine E2 is a water-cooled in-line 4-cylinder 4-cycle internal combustion engine of the spark ignition type carried on a motorcycle (not shown). The internal combustion engine E2 includes a cylinder block 102 wherein four cylinders 102*a* are coupled integrally, a cylinder head 103 coupled to an upper end face of the cylinder block 102, a head cover 104 coupled to an upper end face of the cylinder head 103, and a crankcase 101 coupled to a lower end face of the cylinder block 102. A crankshaft 105 having a rotational axial line L1 on the coupling plane between the cylinder block 102 and the crankcase 101 is disposed horizontally on a vehicle body such that it is directed in the leftward and rightward direction. The crankshaft 105 is supported for rotation between the cylinder block 102 and the crankcase 101 through main bearings 106. A piston 107 is fitted for sliding movement in a cylinder bore 102*b* formed in each of the cylinders 102*a* and is coupled to the crankshaft 105 by a connecting rod 108.

A driving sprocket wheel 109 which forms a driving mechanism for valve motion provided on the cylinder head 103 is spline-coupled to a right end portion 105*a* of the crankshaft 105 such that it rotates integrally with the crankshaft 105. An AC generator 110 is provided at a left end portion 105*b* of the crankshaft 105.

A combustion chamber 111 is formed corresponding to each of the cylinder bores 102*b* in the cylinder head 103. An intake port 112 has a pair of intake valve ports 112*a* which are open to the combustion chamber 111. An exhaust port (not shown) has a pair of exhaust valve ports. The intake port 112 and the exhaust port are formed in the cylinder head 103. Furthermore, for each of the combustion chambers 111, a pair of intake valves 113 for opening and closing the intake valve ports 112*a* and a pair of exhaust valves for opening and closing the exhaust valve ports are provided. Each of the intake valves 113 and the exhaust valves is normally biased by spring force of a valve spring so as to close a corresponding one of the intake valve ports 112*a* and the exhaust valve ports.

A valve motion for operating each of the intake valves 113 and each of the exhaust valves to open and close is provided in a valve motion chamber 114 formed by the cylinder head 103 and the head cover 104. The valve motion includes an intake camshaft 115 and an exhaust camshaft having a rotational axial line L4 parallel to the rotational axial line L1 of the crankshaft 105 and supported for rotation on the cylinder head 103. An intake cam 116 is formed integrally on the intake camshaft 115 for operating the corresponding intake valve 113 to open and close. An exhaust cam is formed integrally on the exhaust camshaft for operating the corresponding exhaust valve to open and close. Furthermore, a lifter 117 is fitted for sliding movement in the cylinder head 103 for slidably contacting with the intake cam 116 or the exhaust cam.

A timing chain 119 is wound around the driving sprocket wheel 109. Furthermore, an intake cam sprocket wheel 118 and exhaust cam sprocket wheel are provided at right end portions of the intake camshaft 115 and the exhaust camshaft, respectively, so that the intake camshaft 115 and the exhaust camshaft are driven to rotate at a speed equal to one half that of the crankshaft 105. Therefore, the intake cam sprocket wheel 118 and the exhaust cam sprocket wheel are rotatable members which are driven to rotate in synchronism with the crankshaft 105 by power of the crankshaft 105. The intake camshaft 115 and the exhaust camshaft are rotatable members which are driven to rotate by the power of the crankshaft 105 and simultaneously are rotatable members which rotate in synchronism with the intake cam 116 and the exhaust cam. A cam phase variable apparatus P2 for advancing or delaying the opening and closing timings of the intake valves 113 non-stepwise to vary the phase of the intake cam 116 with respect to the crankshaft 105 is provided at a right end portion of the intake camshaft 115 rightwardly of the intake cam sprocket wheel 118.

In each of the cylinders 102*a*, upon opening of the intake valves 113 in pair, mixture of fuel and air from an intake apparatus including an intake manifold connected to one side face of the cylinder head 103 flows through the intake port 112 into the combustion chamber 111 and is ignited substantially at the center of the combustion chamber 111 by an ignition plug 120 mounted on the cylinder head 103 so that the fuel is burned. The piston 107 is then driven to move to the bottom dead center by the pressure of the thus produced combustion gas, whereupon the crankshaft 105 is driven to rotate. Thereafter, upon opening of the exhaust valves in pair, the burned gas is acted upon by the pressure of the burned gas itself and the piston 107 moving toward the top dead center so that it flows out through the exhaust port to an exhaust system including an exhaust manifold connected to the other side face of the cylinder head 103.

The power of the crankshaft 105 is then transmitted to the rear wheel, which serves as a driving wheel, through a primary reduction gear including a primary driving gear 121 at the right end of the crankshaft 105, which serves as a crank web. The power is then transmitted through a multiple disc friction clutch, a gear transmission of the normally meshing type and a secondary reduction gear including a transmission chain so that the rear wheel is driven to rotate.

Figure 10:
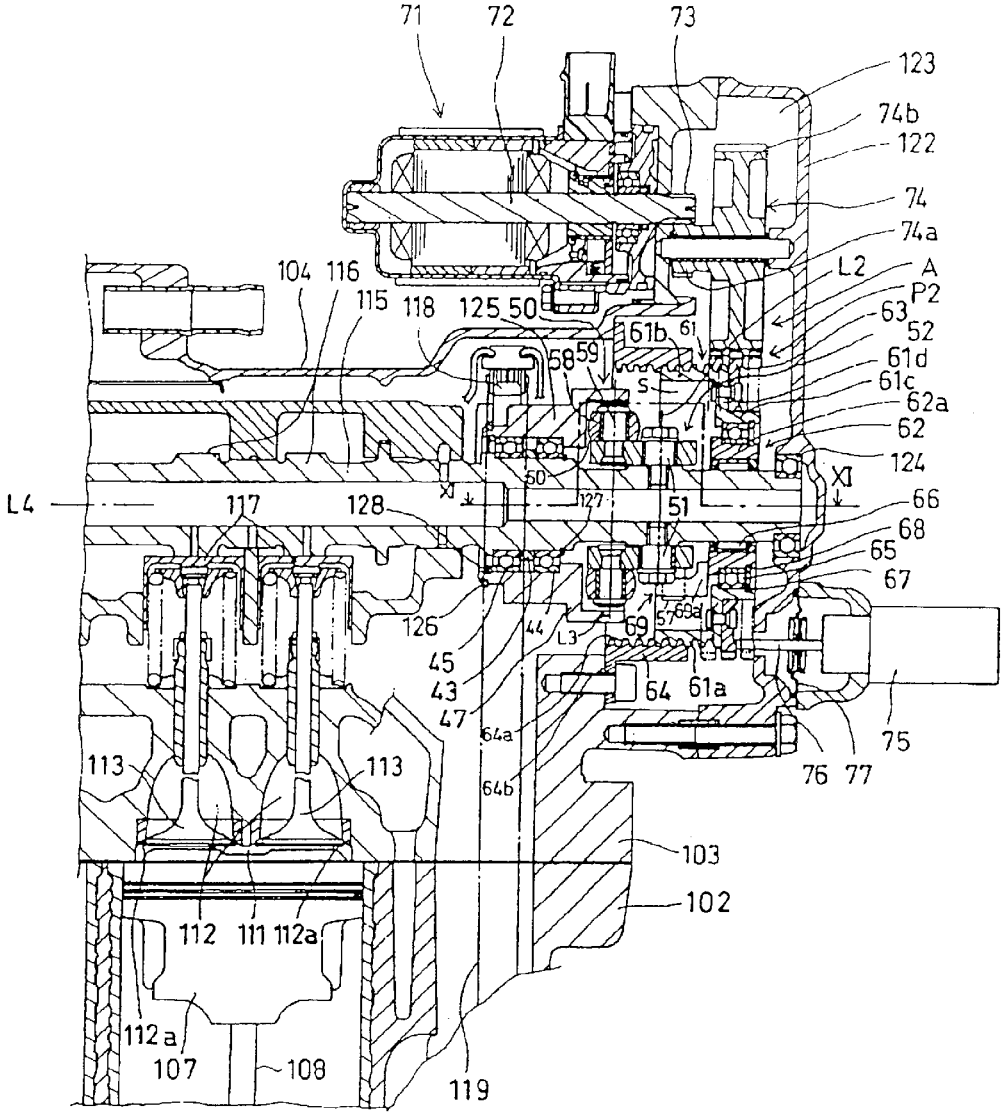
FIG. 10 is an enlarged view of essential part of FIG. 9.

Referring to FIG. 10, the cam phase variable apparatus P2 is accommodated in an accommodation chamber 123, which is formed from right end portions of the cylinder head 103 and the head cover 104 and a cover 122 fastened to the right end portions of the cylinder head 103 and the head cover 104 by means of bolts. A rightmost end portion of the intake camshaft 115 is supported on the cover 122 through a ball bearing 124.

The intake cam sprocket wheel 118 is coupled in a meshing engagement to an outer periphery of a cylindrical holding tube 125, which is supported for rotation on the intake camshaft 115 by means of a pair of ball bearings 44 and 45, such that the intake cam sprocket wheel 118 rotates integrally with the holding tube 125. A movement of the intake cam sprocket wheel 118 in an axial direction is stopped by a snap ring 126 mounted on the holding tube 125. Therefore, the intake cam sprocket wheel 118 and the holding tube 125 are rotatable members, which are driven to rotate by power of the crankshaft 105 in synchronism with the crankshaft 105. The ball bearing 44 contacts with an offset portion of the holding tube 125 and a snap ring 127 mounted on the intake camshaft 115. The other ball bearing 45 is disposed in a neighboring relationship with the ball bearing 44 with the spacer 43 interposed therebetween and contacts with a flange portion of the intake camshaft 115. A snap ring 128 is mounted on the holding tube 125 so that a movement of the holding tube 125 in an axial direction with respect to the intake camshaft 115 is stopped.

Figure 11:
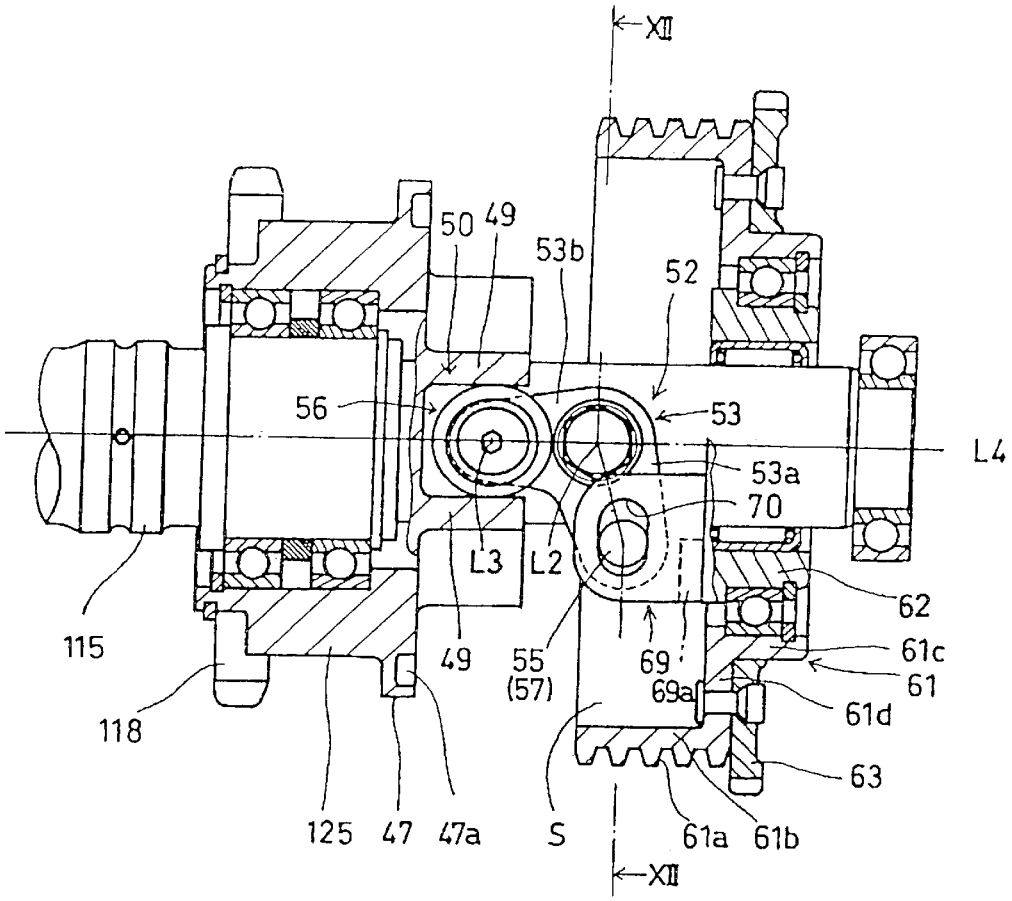
FIG. 11 is a sectional view taken along line XI—XI of FIG. 10 showing essential part of the cam phase variable apparatus in an initial position.
Figure 12:
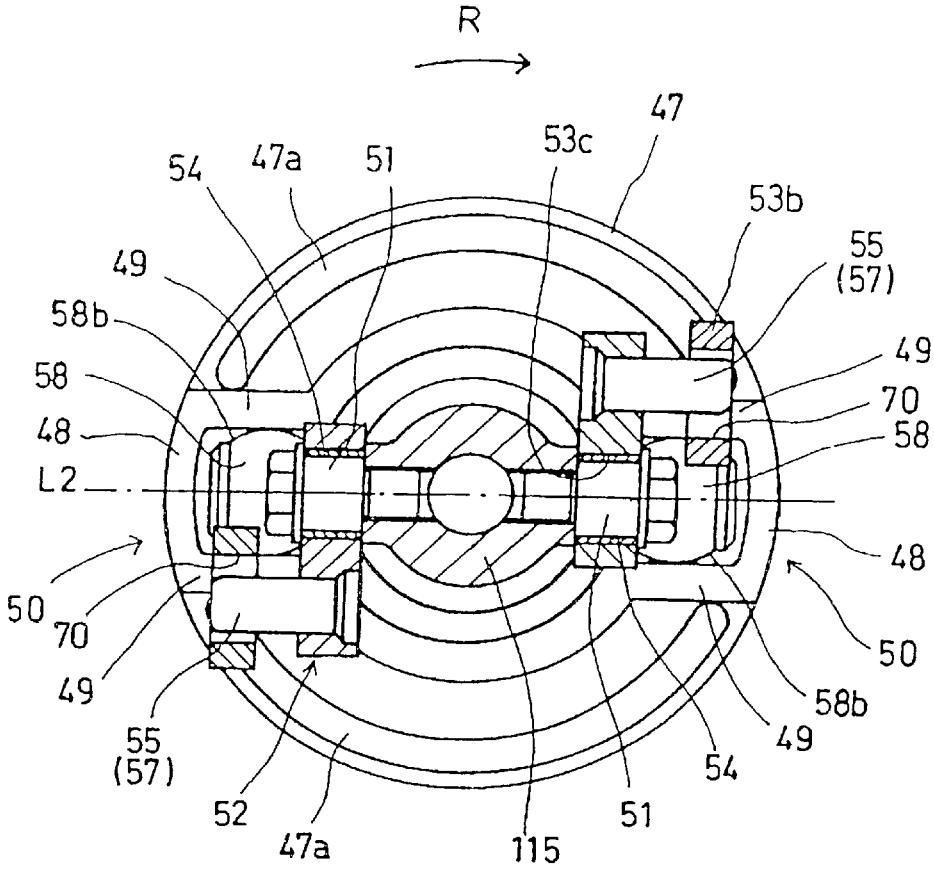
FIG. 12 is a sectional view taken along line XII—XII of FIG. 11.

Referring to FIGS. 11 and 12, a flange 47 and a pair of engaging portions 50 similar to those on the cam tube 12 in the first embodiment are formed on the holding tube 125. Each of the engaging portions 50 is formed as an accommodation chamber surrounded by the flange 47, outer circumferential wall 48 and circumferential walls 49 in pair. A pair of grooves 47*a*, into which the setting shaft 79 is to be fitted, are formed on the flange 47.

The cam phase variable apparatus P2 includes a pair of levers 52 individually supported on a pair of center bolts 51 secured to the intake camshaft 115, and a driving apparatus A (refer to FIG. 10) for rocking the levers 52. Each of the levers 52 is formed from a body 53 having a first arm 53*a*, a second arm 53*b* and a through-hole 53*c*, and a pair of engaging portions 55 and 56. Each of the levers is supported on a center bolt 51 through a bush 54 for rocking motion around a center axial line L2 perpendicular to the rotational axial line L4 of the intake camshaft 115. A first operating arm is formed from the first arm 53*a* and the engaging portion 55, which is formed from a pin 57 inserted in an elongated hole 70 of an engaging portion 69 formed on an operation member 62. A second operating arm is formed from the second arm 53*b* and the engaging portion 56 formed from a pin 59, a roller 58 and a bush 60. The rotational axial line L3 of the roller 58 lies on a plane including the rotational axial line L4 and the center axial line L2 in an initial position of the cam phase variable apparatus P2 shown in FIGS. 10 to 12. The roller 58 is normally held in contact at an outer circumferential face 58*b* thereof with an inner face of a circumferential wall 49, while the roller 58 is accommodated in an engaging portion 50. Consequently, power of the crankshaft 105 is transmitted to the intake camshaft 115 through the driving sprocket wheel 109, timing chain 119, intake cam sprocket wheel 118, holding tube 125, levers 52 and center bolts 51. Accordingly, the intake camshaft 115 is driven to rotate integrally with the intake cam 116 by the power of the crankshaft 105.

Referring to FIG. 10, the driving apparatus A includes a first driving portion, and a second driving portion including an electric motor 71 and a reduction gear 74. The first driving section is coaxial with the intake camshaft 115 and has a fixed portion and a movable portion, which is movable in an axial direction with respect to the intake camshaft 115.

As shown in FIGS. 10 to 12, the movable portion includes a transmission member 61 and an operation member 62 whose rotational axial lines are the rotational axial line L4. The fixed portion is formed from a guide member 64. The guide member 64 whose center axial line is the rotational axial line L4 is secured at a flange 64*b* thereof to the cylinder head 103 and the head cover 104 by means of bolts. A female threaded portion 64*a* in the form of a trapezoidal screw is formed on the guide member 64.

The transmission member 61 has a small diameter portion 61*c* and a large diameter portion 61*b* which has an outer circumference on which a male threaded portion 61*a* in the form of a trapezoidal screw for meshing engagement with the female threaded portion 64*a* is formed. A driven gear 63 is secured to an offset portion 61*d* between the large diameter portion 61*b* and the small diameter portion 61*c*. A ball bearing 65 is provided between the small diameter portion 61*c* of the transmission member 61 and a cylindrical portion 62*a* of the operation member 62 and secured by a pair of snap rings 67 and 68. Furthermore, a needle bearing 66 is provided between the cylindrical portion 62*a* and the intake camshaft 115. Consequently, the transmission member 61 and the operation member 62 are supported for rotation with respect to the intake camshaft 115, and the operation member 62 is rotatable with respect to the transmission member 61. The operation member 62 can be moved in an axial direction, integrally with the transmission member 61, with respect to the intake camshaft 115 within a range defined by the snap rings 67 and 68.

A pair of engaging portions 69, each having a supporting wall 69*a* and having an elongated hole 70 formed therein, are formed on the operation member 62. The center bolts 51 are positioned in the inner space S such that the transmission member 61 is overlapped to the center bolts 51 as seen from the direction perpendicular to the axial direction of the transmission member 61.

An electric motor 71 is secured to the head cover 104 by means of bolts and has a rotary shaft 72 having a rotational axial line parallel to the intake camshaft 115. The rotary shaft 72 is overlapped to the intake camshaft 115 as seen from the direction perpendicular to the axial direction of the rotary shaft 72. A driving gear 73 of the rotary shaft 72 meshes with the small gear 74*a* of the reduction gear 74, and the large gear 74*b* of the reduction gear 74 meshes with the driven gear 63.

A stroke sensor 75 for detecting an amount of movement, in the axial direction, of the movable portion is provided on the cover 122. The stroke sensor 75 has a rod 76 and a diaphragm 77. A detection signal from the stroke sensor 75 is inputted to an electronic control device not shown. The electronic control device controls the amount of rotation of the electric motor 71 so that the actual phase of the intake camshaft 115, which is rotated relative to the intake cam sprocket wheel 118, may coincide with a phase amount set in advance so as to provide optimum opening and closing timings of the intake valves 113 in accordance with operation states of the internal combustion engine E2 such as the speed and the load. Thereby, the phase of the intake cam 116 with respect to the crankshaft 105 is controlled.

Figure 8A:
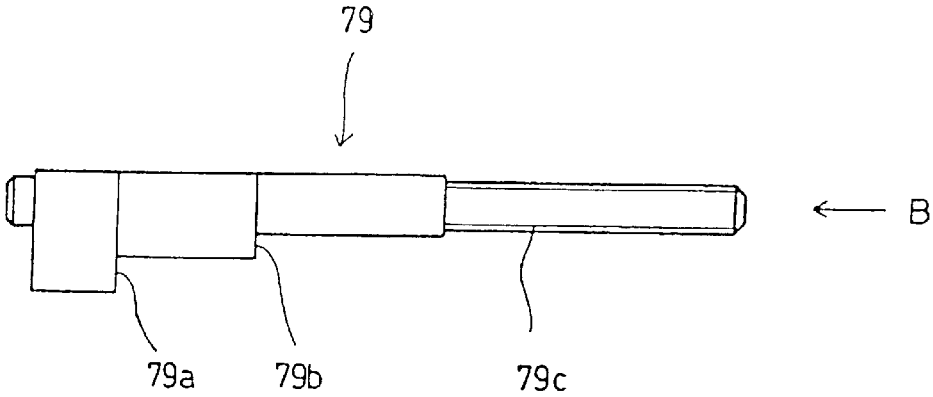
FIG. 8(A) is a front elevational view of a setting shaft.
Figure 8B:
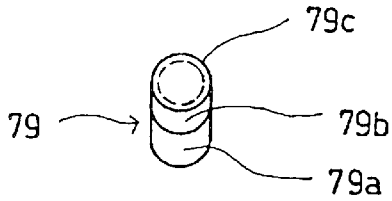
FIG. 8(B) is a view as viewed in the direction of an arrow mark B in FIG. 8(A)

It should be noted that a setting shaft 79 (refer to FIGS. 8(A) and 8(B)) is used to set the relative positions in the axial direction or the relative positions in the rotational direction, of the levers 52, intake camshaft 115, holding tube 125, guide member 64 and transmission member 61 to their initial positions described above in a state wherein the transmission member 61 to which the levers 52, operation member 62 and driven gear 63 are secured and the guide member 64 are assembled to the intake camshaft 115 similarly as in the assembly to the outer shaft 39 in the first embodiment. The intake camshaft 115 is attached to the cylinder head in a state wherein the cam phase variable apparatus P2 is partly assembled to the intake camshaft 115 by the setting shaft 79 and the guide member 64 is secured to the cylinder head 103 and the head cover 104 by means of bolts thereby to assemble the cam phase variable apparatus P2 in the initial position to the internal combustion engine E2. Thereafter, the setting shaft 79 is pulled off.

In the following, operation of the cam phase variable apparatus P2 is described with reference to FIGS. 10 to 14.

When the internal combustion engine E2 is operated, the intake cam sprocket wheel 118 rotates in synchronism with rotation of the crankshaft 105 through the driving sprocket wheel 109 and the timing chain 119. Furthermore, the intake camshaft 115 is rotated through the holding tube 125 and the levers 52. Assume that it is necessary to delay the opening and closing timings of the intake valves 113 to timings suitable for the operation state of the internal combustion engine E2 with respect to a reference phase between the crankshaft 105 and the intake cam 116 set in advance, for example, with reference to a phase set so that the cam phase variable apparatus P2 may assume the initial position shown in FIGS. 10 to 12. The electronic control apparatus described above then outputs a driving signal for causing the electric motor 71 to rotate by a predetermined amount in order to delay the phase of the intake cam 116 in a corresponding relationship to a target phase variation amount from the reference phase. The rotation of the rotary shaft 72 of the electric motor 71 is then transmitted to the driven gear 63 through the reduction gear 74 so that the transmission member 61 integral with the driven gear 63 is moved leftwardly in the axial direction while it is rotated by the feed screw section formed from the female threaded portion 64*a* and the male threaded portion 61*a*. Also the operation member 62 moves leftwardly in the axial direction integrally with the transmission member 61.

Figure 13:
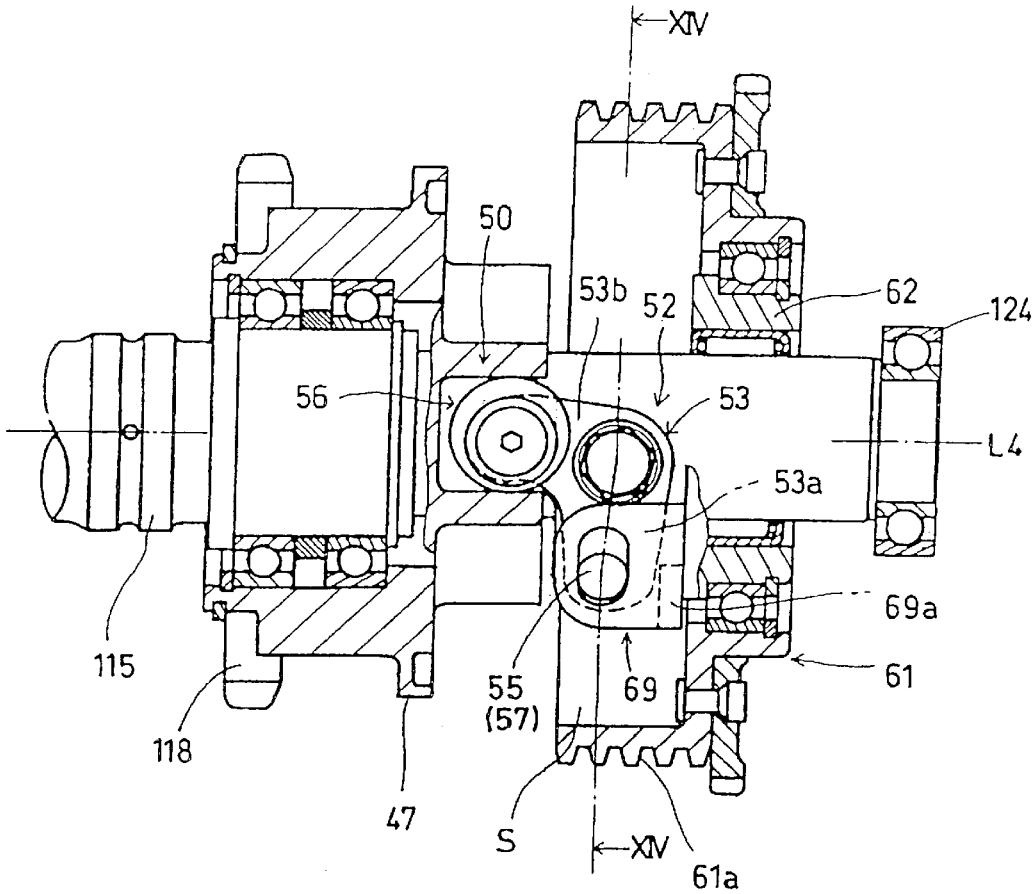
FIG. 13 is a view of the cam phase variable apparatus at a delayed position corresponding to FIG. 11.
Figure 14:
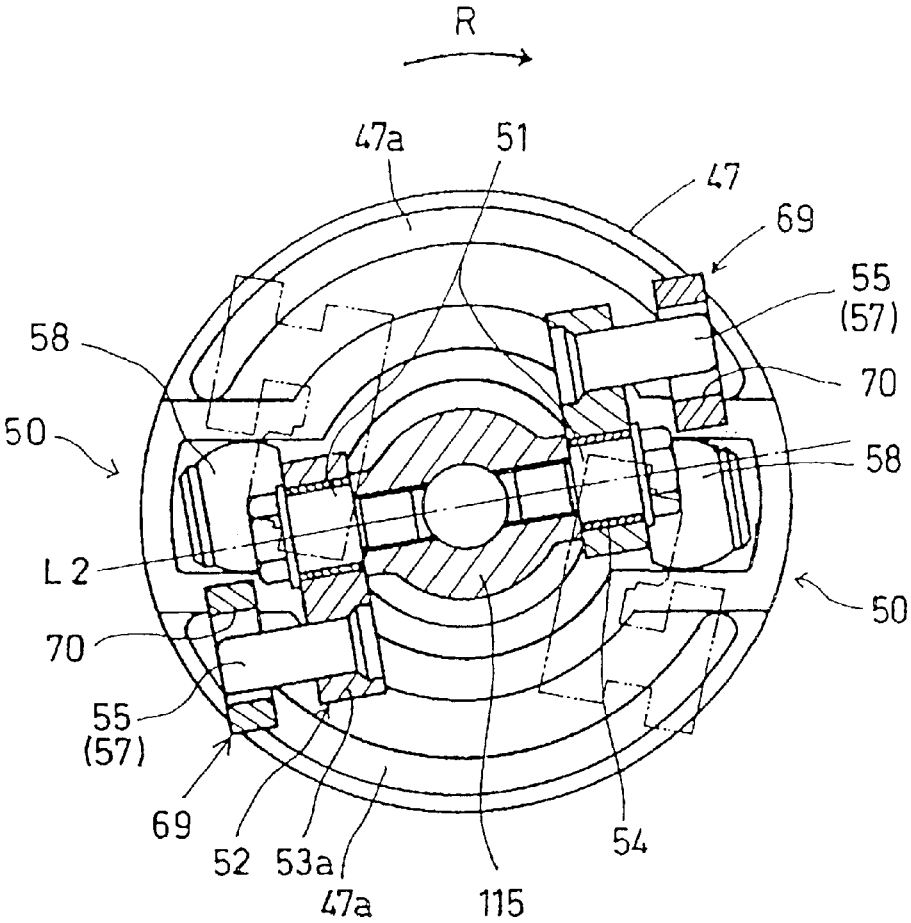
FIG. 14 is a sectional view taken along line XIV—XIV of FIG. 13.

Consequently, the operation member 62 presses in the axial direction the pin 57 of the first operating arm described above through the engaging portion 69 with an operation amount proportional to the amount of rotation in the electric motor 71. At this time, the intake cam sprocket wheel 118 is rotating in a rotating direction R integrally with the crankshaft 105, which is rotating in the rotating direction R, through the timing chain 119. Accordingly, the intake camshaft 115 rotates in the counterclockwise direction in FIGS. 11 and 12 with respect to the intake cam sprocket wheel 118 thereby to vary the phase of the intake cam 116 with respect to the crankshaft 105 to delay the opening and closing timings. Consequently, for example, as shown in FIGS. 13 and 14, the intake camshaft 115 assumes a position rotated with respect to the intake sprocket wheel from the initial position described above (in FIG. 10, the position of the driven gear 63 at this time is indicated by an alternate long and short dash line). The phase variation amount at this time is then detected by the stroke sensor 75 for detecting an amount of movement, in the axial direction, of the driven gear 63. The actual phase variation amount thus detected is inputted to the electronic control apparatus described above to effect feedback control so that the actual phase variation amount may be equal to the target phase variation amount.

By such feedback control, for example, as the speed of rotation of the engine increases, the valve overlap can be increased. Thus, upon low speed rotation, burned gas remaining in the cylinder bore 102*b* can be reduced to assure the stability of combustion, but upon high speed rotation, the volumetric efficiency can be augmented. Furthermore, if it is necessary, from the operation state of the internal combustion engine E2, to advance the opening and closing timings of the intake valves 113, the electric motor 71 should be rotated in the opposite direction to that upon delaying of the opening and closing timings of the internal combustion engine E2 to move the transmission member 61 and the operation member 62 rightwardly thereby to rotate the intake camshaft 115 in the opposite direction relative to the intake cam sprocket wheel 118. Consequently, the driven gear 63 assumes the position indicated by an alternate long and two short dashes line in FIG. 10. Meanwhile, the levers 52 and the engaging portion 69 assume positions rotated in the clockwise direction with respect to the intake cam sprocket wheel 118 and the holding tube 125, for example, as indicated by alternate long and two short dashes lines in FIG. 14.

This makes it possible, for example, to operate the internal combustion engine E2 in so-called Miller cycles wherein the closing timing of the intake valves 113 is set so that air sucked once into the combustion chamber 111 may flow back to the upstream of the intake valves 113 thereby to lower the substantial compression ratio to achieve prevention of knocking and augmentation of the thermal efficiency.

With the second embodiment having the configuration described above, operation and effects similar to those of the first embodiment can be anticipated by replacing the cam tube 12 with the holding tube 125 and replacing the outer shaft 39 with the intake camshaft 115.

In the following, configurations, of embodiments, which are partly modified configurations of the above-described embodiments are described.

In the first embodiment described hereinabove, the outer shaft 39 is provided in order to form part of the cam phase variable apparatus P1 as the assembly part U. However, it is otherwise possible to provide the cam phase variable apparatus P1 and the cam tube 12 on the crankshaft 4 itself without using the outer shaft 39.

The center axial line L2 in the embodiments described above extends perpendicularly to the rotational axial lines L1 and L4. However, it is only necessary that it be present on a plane, which intersects with the rotational axial lines L1 and L4.

In the second embodiment described above, the cam phase variable apparatus P2 is provided on the intake camshaft 115. However, it is otherwise possible to provide the cam phase variable apparatus on the exhaust camshaft or on each of the intake camshaft 115 and the exhaust camshaft. Also it is possible to provide the cam phase variable apparatus between the intake cam 116 (or the exhaust cam) and the camshaft which are rotatable relative to each other. In this instance, the camshaft serves as a driving side member, which is driven to rotate by and in synchronism with the power of the crankshaft, and the intake cam 116 (or the exhaust cam) serves as a cam side member.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cam phase variable apparatus for rotating a driving side member and a cam side member relative to each other in order to vary a phase of the cam side member with respect to the driving side member, the driving side member being formed from a driving rotary shaft or a rotatable member driven to rotate by power of the driving rotary shaft, the cam side member being formed from a cam driven to rotate by the power of the driving rotary shaft or a rotatable member rotated in synchronism with the cam, said cam phase variable apparatus comprising:

a support shaft, said support shaft being provided on a first rotatable member formed from one of the driving side member and the cam side member;

a lever, said lever being supported on said support shaft for rocking motion around a center axial line on a plane intersecting with an axial line of rotation of said first rotatable member; and a driving apparatus, said driving apparatus being provided on said support shaft for rocking said lever, wherein said lever has a first operating arm for engaging with said driving apparatus and a second operating arm for engaging with a second rotatable member formed from the other of the driving side member and the cam side member, and wherein said lever transmits the power of the driving side member to the cam side member and provides relative rotation between said first rotatable member and said second rotatable member having a common axial line of rotation when said lever is rocked by said driving apparatus.

2. A cam phase variable apparatus according to claim 1, wherein said second operating arm and said second rotatable member engage with each other in a circumferential direction through contact of a spherical face of an engaging portion of one of said second operating arm and said second rotatable member with an engaging portion of the other of said second operating arm and said second rotatable member.

3. A cam phase variable apparatus according to claim 1, wherein said driving apparatus comprises:

a first driving portion, said first driving portion including a movable portion provided coaxially with said first rotatable member and movable in an axial direction with respect to said first rotatable member; and a second driving portion, said second driving portion including a driving force generation member for causing said movable portion to move in the axial direction, wherein said movable portion includes a transmission member movable in the axial direction and rotatable with respect to said first rotatable member and an operation member rotatable with respect to said transmission member and movable in the axial direction together with said transmission member, wherein said transmission member is moved in the axial direction by said driving force generation member, and wherein said operation member engages with said first operating arm.

4. A cam phase variable apparatus according to claim 2, wherein said driving apparatus comprises:

a first driving portion, said first driving portion including a movable portion provided coaxially with said first rotatable member and movable in an axial direction with respect to said first rotatable member; and a second driving portion, said second driving portion including a driving force generation member for causing said movable portion to move in the axial direction, wherein said movable portion includes a transmission member movable in the axial direction and rotatable with respect to said first rotatable member and an operation member rotatable with respect to said transmission member and movable in the axial direction together with said transmission member, wherein said transmission member is moved in the axial direction by said driving force generation member, and wherein said operation member engages with said first operating arm.

5. A cam phase variable apparatus according to claim 3, wherein a driven member is provided on said transmission member, said transmission member being formed from a cylindrical member, said driven member rotating together with said transmission member, the rotational driving force from said driving force generation member being transmitted to said driven member, and wherein a threaded portion is formed on a circumferential face of said transmission member, said threaded portion for meshing with a threaded portion provided at a fixed portion of said first driving portion to move said transmission member in the axial direction upon rotation of said transmission member.

6. A cam phase variation member according to claim 5, wherein said support shaft is positioned in an internal space of said transmission member and disposed such that said support shaft and said transmission member overlap with each other as seen from a direction perpendicular to the axial direction.

7. A cam phase variable apparatus according to claim 5, further comprising:

a stroke sensor for detecting an amount of movement of said movable portion in the axial direction: and a control apparatus for controlling said driving force generation member based on a detection signal of said stroke sensor.

8. A cam phase variable apparatus according to claim 6, further comprising:

a stroke sensor for detecting an amount of movement of said movable portion in the axial direction: and a control apparatus for controlling said driving force generation member based on a detection signal of said stroke sensor.

9. A cam phase variable apparatus according to claim 5, wherein said driving force generation member is an electric motor, and said electric motor is disposed such that a rotary axis thereof and said first rotary member extend in parallel to each other and overlap with each other as seen from the direction perpendicular to the axial direction.

10. A cam phase variable apparatus according to claim 6, wherein said driving force generation member is an electric motor, and said electric motor is disposed such that a rotary axis thereof and said first rotary member extend in parallel to each other and overlap with each other as seen from the direction perpendicular to the axial direction.

11. A cam phase variable apparatus for rotating a driving side member and a cam side member relative to each other in order to vary a phase of the cam side member with respect to the driving side member, said cam phase variable apparatus comprising:

a support shaft, said support shaft being providable on a first rotatable member formed from one of the driving side member and the cam side member;

a lever, said lever being supported on said support shaft for rocking motion around a center axial line on a plane intersecting with an axial line of rotation of the first rotatable member; and a driving apparatus, said driving apparatus being provided on said support shaft for rocking said lever, wherein said lever has a first operating arm for engaging with said driving apparatus and a second operating arm for engaging with a second rotatable member formed from the other of the driving side member and the cam side member, and wherein said lever transmits the power of the driving side member to the cam side member and provides relative rotation between the first rotatable member and the second rotatable member having a common axial line of rotation when said lever is rocked by said driving apparatus.

12. A cam phase variable apparatus according to claim 11, wherein said second operating arm and the second rotatable member are engageable with each other in a circumferential direction through contact of a spherical face of an engaging portion of one of said second operating arm and the second rotatable member with an engaging portion of the other of said second operating arm and the second rotatable member.

13. A cam phase variable apparatus according to claim 11, wherein said driving apparatus comprises:

a first driving portion, said first driving portion including a movable portion providable coaxially with the first rotatable member and movable in an axial direction with respect to the first rotatable member; and a second driving portion, said second driving portion including a driving force generation member for causing said movable portion to move in the axial direction, wherein said movable portion includes a transmission member movable in the axial direction and rotatable with respect to the first rotatable member and an operation member rotatable with respect to said transmission member and movable in the axial direction together with said transmission member, wherein said transmission member is moved in the axial direction by said driving force generation member, and wherein said operation member engages with said first operating arm.

14. A cam phase variable apparatus according to claim 12, wherein said driving apparatus comprises:

a first driving portion, said first driving portion including a movable portion providable coaxially with the first rotatable member and movable in an axial direction with respect to the first rotatable member; and a second driving portion, said second driving portion including a driving force generation member for causing said movable portion to move in the axial direction, wherein said movable portion includes a transmission member movable in the axial direction and rotatable with respect to the first rotatable member and an operation member rotatable with respect to said transmission member and movable in the axial direction together with said transmission member, wherein said transmission member is moved in the axial direction by said driving force generation member, and wherein said operation member engages with said first operating arm.

15. A cam phase variable apparatus according to claim 13, wherein a driven member is provided on said transmission member, said transmission member being formed from a cylindrical member, said driven member rotating together with said transmission member, the rotational driving force from said driving force generation member being transmitted to said driven member, and wherein a threaded portion is formed on a circumferential face of said transmission member, said threaded portion for meshing with a threaded portion provided at a fixed portion of said first driving portion to move said transmission member in the axial direction upon rotation of said transmission member.

16. A cam phase variation member according to claim 5, wherein said support shaft is positioned in an internal space of said transmission member and disposed such that said support shaft and said transmission member overlap with each other as seen from a direction perpendicular to the axial direction.

17. A cam phase variable apparatus according to claim 15, further comprising:

a stroke sensor for detecting an amount of movement of said movable portion in the axial direction: and a control apparatus for controlling said driving force generation member based on a detection signal of said stroke sensor.

18. A cam phase variable apparatus according to claim 16, further comprising:

a stroke sensor for detecting an amount of movement of said movable portion in the axial direction: and a control apparatus for controlling said driving force generation member based on a detection signal of said stroke sensor.

19. A cam phase variable apparatus according to claim 15, wherein said driving force generation member is an electric motor, and said electric motor is disposed such that a rotary axis thereof and said first rotary member extend in parallel to each other and overlap with each other as seen from the direction perpendicular to the axial direction.

20. A cam phase variable apparatus according to claim 16, wherein said driving force generation member is an electric motor, and said electric motor is disposed such that a rotary axis thereof and said first rotary member extend in parallel to each other and overlap with each other as seen from the direction perpendicular to the axial direction.

* * * * *